US007416825B2

(12) United States Patent
Kuboshima et al.

(10) Patent No.: US 7,416,825 B2
(45) Date of Patent: Aug. 26, 2008

(54) SINGLE LAYER TYPE ELECTROPHOTOGRAPHIC PHOTOCONDUCTOR AND IMAGE FORMING DEVICE

(75) Inventors: Daisuke Kuboshima, Osaka (JP); Kazunari Hamasaki, Osaka (JP); Norio Nakai, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 325 days.

(21) Appl. No.: 11/325,061

(22) Filed: Jan. 4, 2006

(65) Prior Publication Data

US 2006/0160005 A1 Jul. 20, 2006

(30) Foreign Application Priority Data

Jan. 18, 2005 (JP) ..... 2005-010557

(51) Int. Cl.
*G03G 5/06* (2006.01)

(52) U.S. Cl. ..... 430/96; 430/56; 430/70; 430/73

(58) Field of Classification Search ..... 430/56, 430/96, 73, 70
See application file for complete search history.

(56) References Cited

U.S. PATENT DOCUMENTS 6,258,499 B1 * 7/2001 Itami ..... 430/66
6,656,650 B1 * 12/2003 Lin et al. ..... 430/56

FOREIGN PATENT DOCUMENTS

JP 10-232503 A 9/1998
JP 10-319804 A 12/1998
JP 2001242656 A * 9/2001

* cited by examiner

*Primary Examiner*—Christopher RoDee
(74) *Attorney, Agent, or Firm*—Carmody & Torrance LLP

(57) ABSTRACT

The present invention provides a single layer type electrophotographic photoconductor which exhibits the small number of generated black spots in a formed image and exhibits the excellent sensitivity characteristic even when the photoconductor is used for a long time or a photoconductor drum is rotated at a high speed and an image display device which includes the single layer type electrophotographic photoconductor. In the single layer type electrophotographic photoconductor which includes a photoconductive layer containing a binding resin, a hole transporting agent and an charge generating agent, the photoconductor contains a water-repellant polycarbonate resin as the binding resin, and a contact angle of pure water (measured temperature: 25° C.) with respect to the photoconductive layer is set to 100° or more.

8 Claims, 5 Drawing Sheets

(a)

(b)

SINGLE LAYER TYPE ELECTROPHOTOGRAPHIC PHOTOCONDUCTOR AND IMAGE FORMING DEVICE

TECHNICAL FIELD

The present invention relates to a single layer type electrophotographic photoconductor and an image forming device, and more particularly, to a single layer type electrophotographic photoconductor which generates few black spots even when the single layer type electrophotographic photoconductor is used for a long time and an image forming device having such a single layer type electrophotographic photoconductor.

BACKGROUND OF THE INVENTION

Conventionally, as an electrophotographic photoconductor provided to an image forming device and the like, an organic photoconductor (OPC) which contains a binding resin (a binder resin), a charge generating agent, and a charge transporting agent (a hole transporting agent, an electron transporting agent) and the like has been used. Such an organic photoconductor has, compared to a conventional inorganic photoconductor, advantages such as the easy manufacturing thereof, the high degree of freedom in structural designing due to the versatile selectable choices of a photoconductor material.

As an organic photoconductor, there have been known an organic single layer type photoconductor which forms a single organic photoreceptive layer in which a binding resin, a charge generating agent and a charge transporting agent (an electron transporting agent, a hole transporting agent) are dispersively existed on a base body, and an organic laminated photoconductor which forms a charge generating layer including a charge generating agent and a binding resin and a charge transporting layer including a charge transporting agent and a binding resin on a base body.

Here, in many cases, the organic single layer type photoconductor is charged in a positive polarity in a charging step and hence, toner powders used as a developing agent for the organic single layer type photoconductor are charged in a positive polarity which is equal to the charged polarity of the photoconductor whereby the toner is adhered to a portion of the photoconductor where a potential is lowered due to the irradiation of light. In this manner, a toner image formed on the surface of the photoconductor is transferred to a transferring sheet using an electrostatic force. Since the transferring sheet is charged in a negative polarity, paper powders which are charged in the negative polarity is easily adhered to the photoconductor charged in the positive polarity whereby there frequently arises a drawback that the organic single layer type photoconductor generates black spots and black stripes on the image.

In view of the above, as an electrophotographic photoconductor which has a function of suppressing the generation of filming, there has been proposed an electrophotographic photoconductor having a repeating unit represented by a following general formula (51) in the photoreceptive layer (for example, see Patent document 1).

(51)

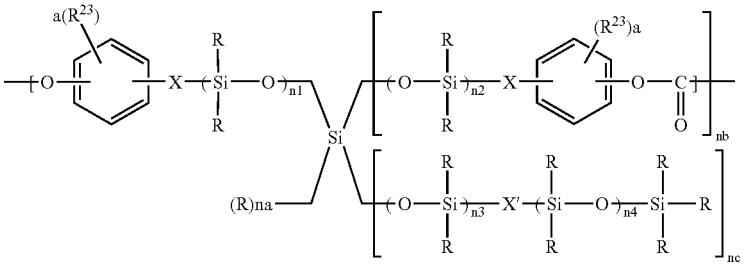

(In the general formula (51), R represents same kinds or different kinds of monohydric hydrocarbon groups which do not contain an aliphatic unsaturated combination, and $R^{23}$ respectively and independently represents a halogen atom, a substituted or unsubstituted alkyl group having 1 to 6 carbons, a substituted or unsubstituted alkoxy group having 1 to 6 carbons, or a substituted or unsubstituted aryl group having 6 to 12 carbons, X respectively and independently represents an alkylene group having 2 or more carbons or an alkylene oxyalkylene group having 2 or more carbons and X' respectively and independently represents an alkylene group having 2 or more carbons, an alkylene oxyalkylene group having 2 or more carbons or an oxygen atom, wherein a respectively and independently represents an integer from 0 to 4, na represents either 0 or 1, nb represents either 1 or 2, nc represents either 1 or 2, provided that na+nb+nc=3, wherein n1, n2, n3 and n4 respectively and independently represent an integer of 0, 1 or more provided that n1+n2+n3+n4=0 to 450.)

Also, there has been disclosed an image forming method having a step in which an electrophotographic photoconductor which has a function of suppressing the generation of filming is used and the toner remaining on the photoconductor is cleaned using a brush and an elastic body rubber blade, wherein a contact angle of a surface of a photoconductor with respect to pure water is set to 90° or more (for example, see Patent Document 2).

[Patent Document 1] JP10-232503A (Claims)

[Patent Document 2] JP10-319804A (Claims)

DISCLOSURE OF THE INVENTION

[Problems to be Solved by the Invention]

Although the electrophotographic photoconductor described in Patent Document 1 contains a polycarbonate resin having the siloxane structure, a value of the contact angle is still low and hence, there has been a drawback that when the electrophotographic photoconductor is rotated at a high speed or a rotational diameter is set to a small value, the electrophotographic photoconductor cannot exhibit the sufficient filming property. Accordingly, there has been observed a drawback that silica and paper powders are easily adhered to the surface of the photoconductor and hence, black spots are easily generated.

Also, in the image forming method described in Patent Document 2, for suppressing the generation of filming, the surface of the photoconductor is cleaned using a brush and an elastic rubber blade as cleaning members, wherein a contact angle of the photoconductor with respect to pure water is set to a value of 90° or more.

However, when the photoconductor is used for a long time, the surface of the photoconductor is abraded by the cleaning member and hence, it is difficult to control the contact angle of the surface of the photoconductor within a given range. Accordingly, there has been observed a drawback that silica and paper powders are easily adhered to the surface of the photoconductor and hence, black spots are easily generated.

In view of the above, inventors of the present invention have found out that when the electrophotographic photoconductor contains a water-repellant polycarbonate resin therein and the contact angle of the pure water with respect to the photoconductive layer is set to a given value or more, it is possible to overcome drawbacks on the generation of black spots attributed to the increase of an addition amount of the hole transporting agent and the enhancement of the polarity of the hole transporting agent for enhancing the sensitivity of the photoconductor, and have completed the present invention.

That is, it is an object of the present invention to provide a single layer type electrophotographic photoconductor which exhibits the excellent sensitivity characteristic even when the photoconductor is used for a long time with a small number of black spots, and an image forming device which has the single layer type electrophotographic photoconductor thereon.

[Means for Solving the Problem]

The present invention is directed to a single layer type electrophotographic photoconductor which includes a photoconductive layer containing a binding resin, a hole transporting agent and a charge generating agent, wherein the photoconductor contains a water-repellant polycarbonate resin as the binding resin, and a contact angle of pure water (measured temperature: 25° C.) with respect to the photoconductive layer is set to 100° or more. By adopting such a constitution, it is possible to overcome the above-mentioned drawbacks.

Further, in constituting the single layer type electrophotographic photoconductor according to the present invention, it is preferable to set the contact angle of the pure water (measured temperature: 25° C.) with respect to the water-repellant polycarbonate resin to 98° or more.

Further, in constituting the single layer type electrophotographic photoconductor according to the present invention, it is preferable that the water-repellant polycarbonate resin includes a polycarbonate resin having the siloxane structure.

Further, in constituting the single layer type electrophotographic photoconductor according to the present invention, assuming a total amount of the polycarbonate resin having the siloxane structure as 100 mol %, it is preferable to set a content ratio of the units having the siloxane structure to a value which falls within a range of 0.1 to 20 mol %.

Further, in constituting the single layer type electrophotographic photoconductor according to the present invention, it is preferable that the polycarbonate resin having the siloxane structure is present non-uniformly in a surface of the photoconductive layer.

Also, in constituting the single layer type electrophotographic photoconductor according to the present invention, it is preferable that the photoconductor contains, as the hole transporting agent, a compound having the contact angle (measured temperature: 25° C.) of 90° or more with respect to the pure water in a resin dispersion film.

Also, in constituting the single layer type electrophotographic photoconductor according to the present invention, it is preferable that the photoconductor contains, as the hole transporting agent, a compound having a triphenylamine skeleton which includes the stilbene structure.

Also, in constituting the single layer type electrophotographic photoconductor according to the present invention, it is preferable that the photoconductor contains, as an additive, at least a compound selected from a group consisting of compounds represented by following general formulae (1) to (4).

(1)

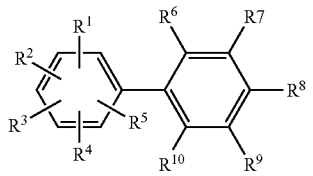

(In the general formula (1), $R^1$ to $R^{10}$ are respectively independent substituted groups and represent a hydrogen atom, a halogen atom, a substituted or unsubstituted alkyl group having 1 to 12 carbons, a substituted or unsubstituted alkoxy group having 1 to 12 carbons, a substituted or unsubstituted aryl group having 6 to 30 carbons, a substituted or unsubstituted aralkyl group having 6 to 30 carbons, a substituted or unsubstituted cycloalkyl group, a hydroxyl group, a cyano group, a nitro group, an amino group or a halogen alkyl group having 3 to 12 carbons.)

(2)

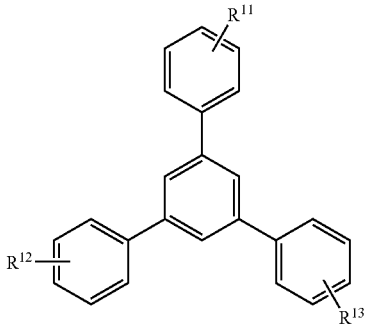

(In the general formula (2), $R^{11}$ to $R^{13}$ are respectively independent substituted groups and represent a hydrogen atom, a halogen atom, a substituted or unsubstituted alkyl group having 1 to 12 carbons, a substituted or unsubstituted alkoxy group having 1 to 12 carbons, a substituted or unsubstituted aryl group having 6 to 30 carbons, a substituted or unsubstituted aralkyl group having 6 to 30 carbons, a substituted or unsubstituted cycloalkyl group, a hydroxyl group, a cyano group, a nitro group, an amino group or a halogen alkyl group having 3 to 12 carbons.)

(3)

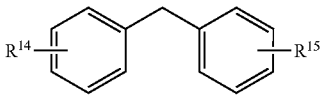

(In the general formula (3), $R^{14}$ and $R^{15}$ are respectively independent substituted groups and represent a hydrogen atom, a halogen atom, a substituted or unsubstituted alkyl group having 1 to 12 carbons, a substituted or unsubstituted alkoxy group having 1 to 12 carbons, a substituted or unsubstituted aryl group having 6 to 30 carbons, a substituted or unsubstituted aralkyl group having 6 to 30 carbons, a substituted or unsubstituted cycloalkyl group, a hydroxyl group, a cyano group, a nitro group, an amino group or a halogen alkyl group having 3 to 12 carbons.)

(4)

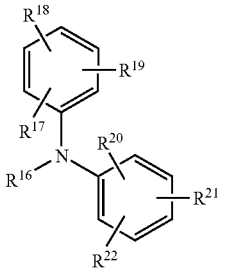

(In the general formula (4), $R^{16}$ to $R^{22}$ are respectively independent substituted groups and represent a hydrogen atom, a halogen atom, a substituted or unsubstituted alkyl group having 1 to 12 carbons, a substituted or unsubstituted alkoxy group having 1 to 12 carbons, a substituted or unsubstituted aryl group having 6 to 30 carbons, a substituted or unsubstituted aralkyl group having 6 to 30 carbons, a substituted or unsubstituted cycloalkyl group, a hydroxyl group, a cyano group, a nitro group, an amino group or a halogen alkyl group having 3 to 12 carbons.)

Further, in constituting the single layer type electrophotographic photoconductor according to the present invention, it is preferable that a content of the additive with respect to a total weight of the photoconductive layer is set to a value which falls within a range of 1.5 to 15 weight %.

Further, in constituting the single layer type electrophotographic photoconductor according to the present invention, it is preferable that the photoconductor provides a drum which diameter is set to 30 mm or less.

Further, another aspect of the present invention is directed to an image forming device which is characterized by including any one of the above-mentioned single layer type electrophotographic photoconductors and, at the same time, by arranging portions which perform a charging step, an exposure step, a developing step and a transferring step around the electrophotographic photoconductor.

Further, in constituting the image forming device according to the present invention, it is preferable that the development step adopts a simultaneous developing and cleaning system.

Further, in constituting the image forming device according to the present invention, it is preferable to set a drum rotational speed to 100 mm/sec or more.

[Advantage of the Invention]

That is, according to the single layer type electrophotographic photoconductor of the present invention, the photoconductor contains the water-repellant polycarbonate resin and the contact angle of the pure water with respect to the photoconductive layer is set to the given value or more and hence, the adhesion of silica and paper powders is effectively prevented whereby the photoconductor exhibits the excellent sensitivity characteristic even after a long-time use thereof thus effectively decreasing the generation of black spots.

Further, according to the single layer type electrophotographic photoconductor of the present invention, by setting the contact angle of the pure water with respect to the water-repellant polycarbonate resin to the given value or more, it is possible to easily adjust the contact angle of the pure water with respect to the photoconductive layer and hence, the adhesion of silica and paper powders is more effectively prevented thus effectively decreasing the generation of black spots.

Further, according to the single layer type electrophotographic photoconductor of the present invention, the photoconductor contains the polycarbonate resin having the siloxane structure as the water-repellant polycarbonate resin and hence, it is possible to easily adjust the contact angle of the pure water with respect to the photoconductive layer and, at the same time, the more excellent durability can be obtained.

Further, according to the single layer type electrophotographic photoconductor of the present invention, by setting the content ratio of the polycarbonate resin having the siloxane structure to a value which falls within a given range, the contact angle of the photoconductive layer can be easily adjusted and hence, the more excellent durability can be obtained.

Further, according to the single layer type electrophotographic photoconductor of the present invention, since the polycarbonate resin having the siloxane structure exists non-uniformly in the surface of the photoconductive layer, it is possible to obtain the excellent filming property and durability even when the content ratio of the polycarbonate resin is relatively small.

Further, according to the single layer type electrophotographic photoconductor of the present invention, the resin dispersion film of the hole transporting agent has the given contact angle and hence, coupled with a water-repellant function of the water-repellant polycarbonate resin, the adhesion of silica and paper powders can be prevented more effectively whereby the generation of black spots can be effectively decreased.

Further, according to the single layer type electrophotographic photoconductor of the present invention, with the use of the compound having the specific structure as the hole transporting agent, the contact angle in the photoconductive layer can be easily adjusted and, at the same time, it is possible to obtain the excellent sensitivity characteristic.

Further, according to the single layer type electrophotographic photoconductor of the present invention, with the use of the compound having the specific structure as the additive, the generation of cracks in a surface of a photoconductor attributed to the adhesion of a contaminant or the like can be suppressed, whereby the generation of black spots and fogging in the image can be prevented.

Further, according to the single layer type electrophotographic photoconductor of the present invention, by setting the content of the additive with respect to the total weight of the photoconductive layer to the value which falls within the given range, it is possible to suppress more effectively the generation of cracks in the surface of the photoconductor attributed to the adhesion of a contaminant whereby the generation of black spots and fogging in the image can be prevented more effectively.

Further, according to the single layer type electrophotographic photoconductor of the present invention, by setting the drum diameter of the photoconductor to the given value or below, the miniaturization of the image forming device can be realized while effectively preventing the generation of black spots.

Further, according to the image forming device of the present invention, the image forming device includes the given single layer type electrophotographic photoconductor, and portions which perform the charging step, the exposure step, the developing step, and the transferring step are arranged around the electrophotographic photoconductor and hence, it is possible to provide the image display device which can exhibit the excellent sensitivity characteristic for a long period and can efficiently reduce a value of an exposure memory thus preventing the generation of black spots and black stripes. That is, it is possible to provide the image forming device which can provide a clear image for a long time.

Further, according to the image forming device of the present invention, it is also possible to omit a charge neutralizing step. In this case, the image forming device can be further miniaturized and it is also possible to effectively lower costs by decreasing the number of parts.

Further, according to the image forming device of the present invention, by adopting a simultaneous developing and cleaning system, it is possible to simplify the image forming device and, at the same time, to further miniaturize the image forming device.

Further, according to the image forming device of the present invention, by setting the drum rotational speed of the photoconductor to the given value or more, the image forming can be performed at a high speed and hence, the image forming efficiency can be enhanced.

BEST MODE FOR CARRYING OUT THE INVENTION

First Embodiment

The first embodiment is directed to a single layer type electrophotographic photoconductor which includes a photoconductive layer containing a binding resin, a hole transporting agent and an electron generating agent, wherein the photoconductor contains a water-repellant polycarbonate resin as the binding resin, and a contact angle of pure water with respect to the photoconductive layer is set to 100° or more.

1. Basic Constitution (1) Structure

Figure 1:
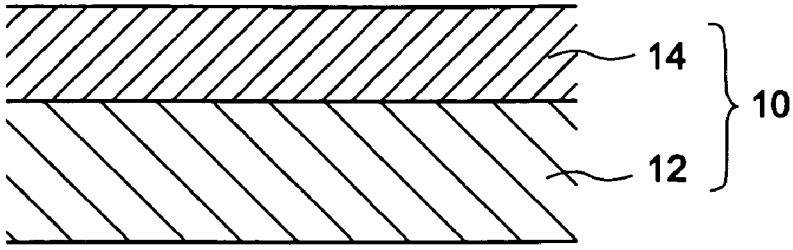
FIG. 1(*a*) and FIG. 1(*b*) are views for explaining the basic structure and the modified structure of a single layer type photoconductor.
Figure 1:
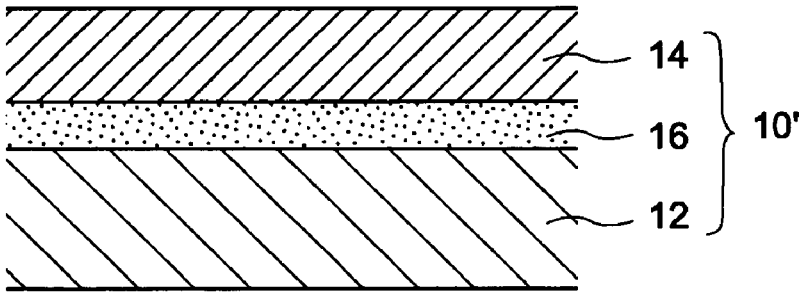

As shown in FIG. 1(*a*), a single layer type photoconductor 10 is configured by having a single photoconductive layer 14 on a base body 12.

The photoconductive layer contains a binding resin, a hole transporting agent and a charge generating agent. Further, the photoconductive layer also contains an electron transporting agent, a leveling agent or an additive such as silyl-group containing compound or the like when necessary.

The obtained single layer type photoconductor contains a water-repellant polycarbonate resin and a contact angle of pure water with respect to a photoconductive layer is set to 100° or more and hence, the single layer type photoconductor is characterized by capable of suppressing the generation of filming and, eventually, the generation of black spots.

Further, when the photoconductive layer of the single layer type photoconductor is allowed to further contain an electron transporting agent, the transmission and the reception of electrons between the charge generating agent and the hole transporting agent can be effectively performed and hence, the tendency that the sensitivity and the like is further stabilized is observed.

(2) Binding Resin (2)-1 Water Repellency

This embodiment is characterized in that the single layer type electrophotographic photoconductor contains a water-repellant polycarbonate resin as the binding resin.

The reason is that by allowing the single layer type electrophotographic photoconductor to contain the water-repellant polycarbonate resin, it is possible to easily adjust the contact angle of pure water with respect to the photoconductive layer and, at the same time, paper powders and silica and the like are hardly adhered to the photoconductive layer and hence, the generation of black spots and black stripes can be suppressed at the time of forming images. That is, even when the hole transporting agent having high polarity is used in the single layer type electrophotographic photoconductor, the function of suppressing the generation of the filming can be maintained and hence, it is possible to provide a clear image having neither black spots nor black stripes and the like for a long time. Further, with the use of the water-repellant polycarbonate resin having the given contact angle, it is possible to provide the single layer type electrophotographic photoconductor which is excellent not only in transparency and heat resistance but also in mechanical property and compatibility with the hole transporting agent and, further, is excellent in durability.

Accordingly, with respect to the water-repellant polycarbonate resin, to be more specific, it is preferable that the contact angle thereof with respect to the pure water (measured temperature condition: 25° C.) is set to 98° or more. The reason is that when the contact angle with respect to the pure water becomes less than 98°, there may be a case that the adjustment of the contact angle in the photoconductive layer becomes difficult.

Here, the contact angle of the water-repellant polycarbonate resin with respect to the pure water is, as described in the embodiment 1, may be measured using a resin film having a film thickness of 25 μm as an object. That is, the resin film is obtained such that a THF liquid having 25% of resin concentration is applied to an aluminum substrate using a dip coating method and, then, the THF liquid is dried with hot air under conditions of 100° C. and 40 minutes. Then, the contact angle of the resin film with respect to the pure water is measured by a liquid drop method using a contact angle meter (manufactured by Kyowa Interface Science Co. Ltd., FACE-CONTACT-ANGLE METER).

Figure 2:
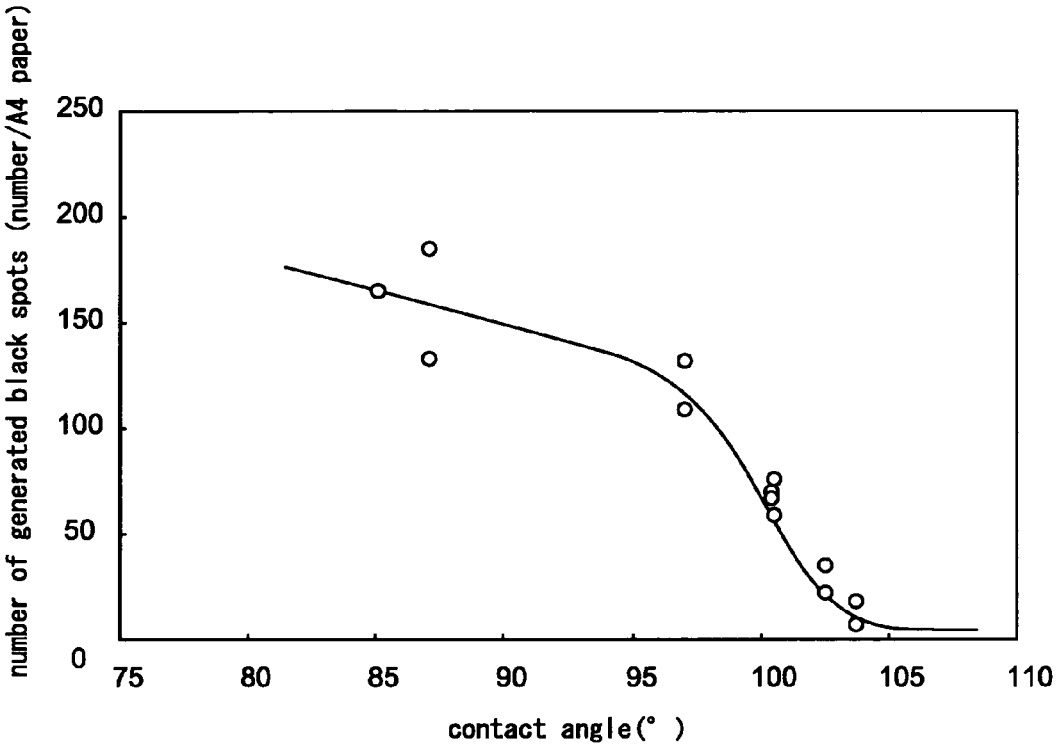
FIG. 2 is a view for explaining the relationship between a contact angle of pure water with respect to a water-repellant polycarbonate resin and the generation of black spots.

Here, the relationship between the contact angle of pure water with respect to the water-repellant polycarbonate resin and the number of generated black spots per unit area is explained in conjunction with FIG. 2. The contact angle (°) on the surface of the water-repellant polycarbonate resin is taken on an axis of abscissas in FIG. 2 and the number of generated black spots per a sheet of A4 paper (number/A4 paper) is taken on an axis of ordinate.

As can be easily understood from FIG. 2, when the contact angle with respect to the water-repellant polycarbonate resin becomes 98° or more, the number of generated black spots becomes 130 or less (number/A4 paper) and hence, the black spots are efficiently decreased. Accordingly, it is considered that by controlling the contact angle of the binding resin to the given value or more, even when the hole transporting agent having the high polarity is used, it is possible to effectively reduce the generation of black spots.

Here, when the contact angle with respect to the water-repellant polycarbonate resin becomes excessively large, there may arise a case that kinds of water-repellant polycarbonate resin and the like which can be selected becomes excessively small.

Accordingly, it is more preferable to set the contact angle of pure water with respect to the water-repellant polycarbonate resin to a value which falls within a range of 98° to 120° and it is much more preferable to set the contact angle to a value which falls within a range of 103° to 110°.

(2)-2 Content Ratio

Also, assuming a total amount of all the components except the agent used for the single layer type photoconductive layer as 100 parts by weight, it is preferable to set the content ratio of the water-repellant polycarbonate resin to a value which falls within a range of 35 to 60 parts by weight.

The reason is that when the content ratio of the water-repellant polycarbonate resin assumes a value below 35 parts by weight, there may be case that the adjustment of the contact angle in the photoconductive layer becomes difficult, while when the content ratio of the water-repellant polycarbonate resin exceeds 60 parts by weight, there may be case that an adhesive strength between the photoconductive layer and the base body is extremely lowered.

Accordingly, assuming a total amount of the binding resin used for the single layer type photoconductive layer as 100 parts by weight, it is more preferable to set the content ratio of the water-repellant polycarbonate resin to a value which falls within a range of 35 to 60 parts by weight, and it is still more preferable to set the content ratio of the water-repellant polycarbonate resin to a value which falls within a range of 40 to 55 parts by weight.

(2)-3 Viscosity Average Molecular Weight

It is preferable that the viscosity average molecular weight of the water-repellant polycarbonate resin used in the single layer type photoconductive layer according to the present invention is set to a value which falls within a range of 10,000 to 60,000.

The reason is that with the use of the water-repellant polycarbonate resin having such viscosity average molecular weight, it is possible to provide the photoconductive body which exhibits the excellent durability.

Here, the viscosity average molecular weight (M) of the water-repellant polycarbonate resin is calculated by obtaining a limit viscosity [η] using Ostwald viscosmeter and, then, by inputting [η] to the Schnell's formula $[\eta]=1.23\times10^{-4}M^{0.83}$. Here, [η] may be measured using a polycarbonate resin solvent obtained by dissolving polycarbonate resin in a dichloromethane solution which is used as the solvent such that the concentration (C) of the solvent becomes 6.0 g/dm$^3$ at a temperature of 20° C.

(2)-4 Existing Ratio

Further, it is preferable that the polycarbonate resin having the siloxane structure is non-uniformly present in the front surface of the photoconductive layer. That is, it is preferable that the larger amount of polycarbonate resin having the siloxane structure is present in the front surface of the photoconductive layer compared to the inside or the back surface of the photoconductive layer.

The reason is that due to the non-uniform presence of the polycarbonate resin having the siloxane structure in the front surface of the photoconductive layer, even when the content ratio is relatively small, the photoconductive layer can obtain the excellent filming characteristic and the excellent durability.

Here, whether the polycarbonate resin having the siloxane structure is present non-uniformly or not can be calculated by comparison using a NMR or a FT-IR chart or can be determined by performing an elemental analysis using an XPM or the like.

(2)-5 Kinds

Further, with respect to kinds of the water-repellant polycarbonate resin, it is preferable to use the polycarbonate resin having the siloxane structure.

The reason is that with the use of the polycarbonate resin having such a structure, it is possible to easily adjust the contact angle in the photoconductive layer and, at the same time, the photoconductive layer can obtain the further excellent durability.

Further, assuming the whole polycarbonate resin having the siloxane structure as 100 mol %, it is preferable to set the content ratio of the unit having the siloxane structure to a value which falls within a range of 0.1 to 20 mol %.

The reason is that when the photoconductive layer contains a given amount of the polycarbonate resin having such a structure, it is possible to easily adjust the contact angle in the photoconductive layer and, at the same time, the photoconductive layer can obtain the further excellent durability.

Here, the repetition number of the polycarbonate resin having the siloxane structure expressed later by a formula (6) indicates a mole ratio of copolymerization components and expresses that the mole ratio of each constitutional unit is set to 95:5. Accordingly, assuming the whole resin expressed by the formula (6) as 100 mol %, the content ratio of the unit having the siloxane structure becomes 5 mol %. Further, such a mole ratio can be calculated by a nuclear magnetic resonance analytical equipment (NMR), for example.

Further, one example of the preferred polycarbonate resin having the siloxane structure is expressed by a following formula (5).

(5)

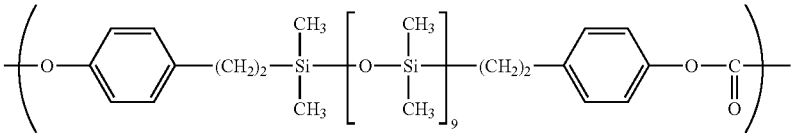

(2)-6 Specific Example

Further, as the water-repellant polycarbonate resin having the given contact angle used in the present invention, polycarbonate resins (Resin-A to D) having following formulae (6) to (9) are named.

(6)

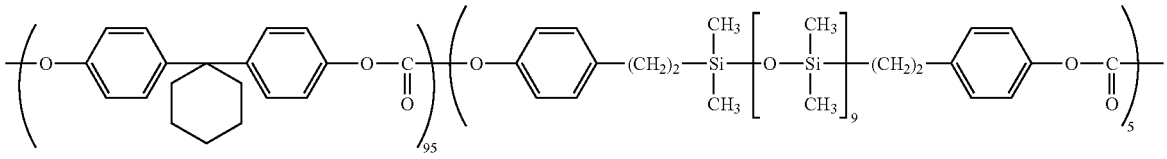

(Resin-A)

(7)

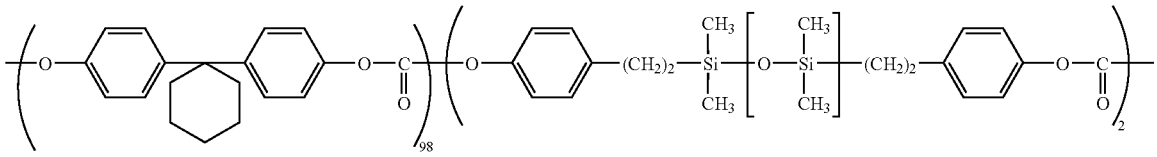

(Resin-B)

(8)

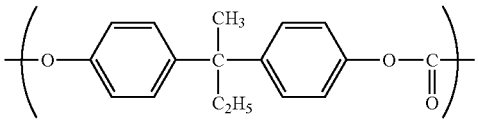

(Resin-C)

(9)

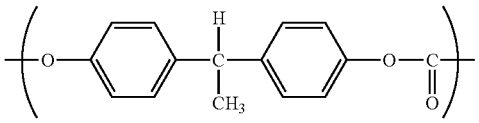

(Resin-D)

Also in the present invention, it is possible to combine many kinds of binding resins which are conventionally used for the photoconductive layer. For example, a single use or a combination of two or more kinds of a styrene-butadiene copolymer, a styrene-acrylonitrile copolymer, a styrene-maleic acid copolymer, an acrylic copolymer, a styrene-acrylic acid copolymer, a polyethylene resin, an ethylene-vinyl acetate copolymer, a thermoplastic resin such as a chlorinated polyethylene resin, a poly vinyl chloride resin, a polypropylene resin, an ionomer resin, a vinyl chloride-vinyl acetate copolymer, a polyester resin, an alkyd resin, a polyamide resin, a polyurethane resin, a polycarbonate resin, a polyarylate resin, a polysulfone resin, a diallyl phthalate resin, a ketone resin, a polyvinyl butyral resin, a polyether resin, a polyester resin and the like; a silicone resin, an epoxy resin, a phenol resin, a urea resin, a melamine resin and other cross-link thermosetting resin; a photocuring resin such as epoxy acrylate, urethane-acrylate and the like may be named.

(3) Hole Transporting Agent (3)-1 Contact Angle

Further, it is preferable to set the contact angle of the resin dispersion film of the hole transporting agent with respect to pure water to 90° or more.

The reason is that with the use of the hole transporting agent in the single layer type electrophotographic photoconductor of the present invention, the adhesion of the silica and the paper powder to the photoconductor can be further effectively prevented and hence, it is possible to further efficiently reduce the generation of black spots.

Accordingly, it is preferable to set the contact angle of the resin dispersion film of the hole transporting agent with respect to pure water to a value which falls within a range of 95° to 120°. It is still more preferable to set the contact angle to a value which falls within a range of 1000 to 110°.

Here, the contact angle of the resin dispersion film of the hole transporting agent with respect to pure water can be measured by a method described in the embodiment 1. That is, a solution is obtained by mixing and dispersing 43 parts by weight of the hole transporting agent, 100 parts by weight of the Z-type polycarbonate resin (TS2020, made by Teijin Chemical Ltd) having a viscosity average molecular weight of 20,000, 0.1 parts by weight of dimethyl polysiloxane (KF-90, 50 cps, made by Shin-Etsu Chemical Co. Ltd.), and 800 parts by weight of tetrahydrofuran. The obtained solution is applied to an aluminum substrate by a dip coating method and is dried with hot air for 40 minutes at a temperature of 100° C. thus producing a hole transporting agent resin dispersion film having a film thickness of 25 μm. Next, a contact angle (measured temperature: 25° C.) of the hole transporting agent resin dispersion film with respect to pure water can be measured by a liquid drop method using a contact angle meter (made by Kyowa Interface Science Co. Ltd. FACE-CONTACT-ANGLE METER).

(3)-2 Kinds

Further, according to the present invention, as the hole transporting agent, it is preferable that the hole transporting agent contains at least one kind of compound which has a triphenylamine skeleton including a stilbene structure or a triphenylamine skeleton not including the stilbene structure. The reason is that the hole transporting agent having the above-mentioned structure exhibits the excellent sensitivity characteristic and, at the same time, the contact angle can be easily adjusted and hence, it is possible to effectively suppress the generation of filming.

Further, it is still more preferable that the hole transporting agent contains a compound having a triphenylamine skeleton including the stilbene structure. The reason is that the hole transporting agent including the above-mentioned structure can further enhance the compatibility of the photoconductor with the binding resin and hence, it is possible to enhance the durability and the sensitivity characteristic of the photoconductor.

Further, the hole transporting agent of the triphenylamine skeleton including such stilbene structure is typically formed of a compound which has the stilbene structure in the center thereof and has the triphenylamine skeleton at the both ends thereof like compounds expressed by formulae (10) to (13) described later. In the same manner, the hole transporting agent of the triphenylamine (triarylamine) skeleton not including the stilbene structure is formed of a compound of a carbocyclic ring structure which has a triphenylamine skeleton not having the stilbene structure in the center thereof like compounds expressed by formulae (14) to (21) described later.

Further, as the hole transporting agent which can be preferably used in the single layer type electrophotographic photoconductor according to the present invention, to be more specific, compounds (HTM-A to L) represented by the following formulae (10) to (21) may be named.

(10)

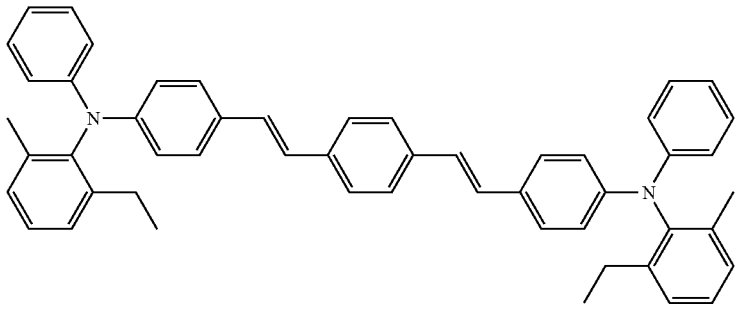

(HTM-A)
Contact Angle 90.2°

(11)

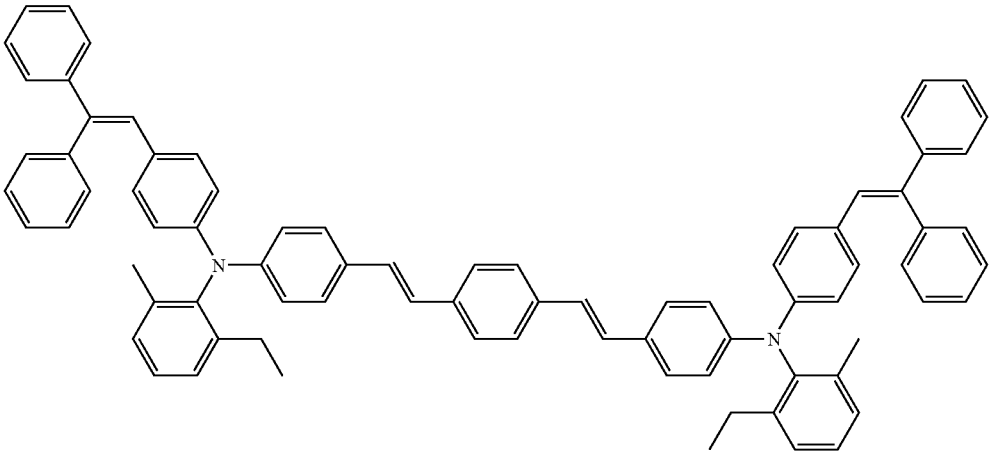

(HTM-B)
Contact Angle 88.0°

(12)

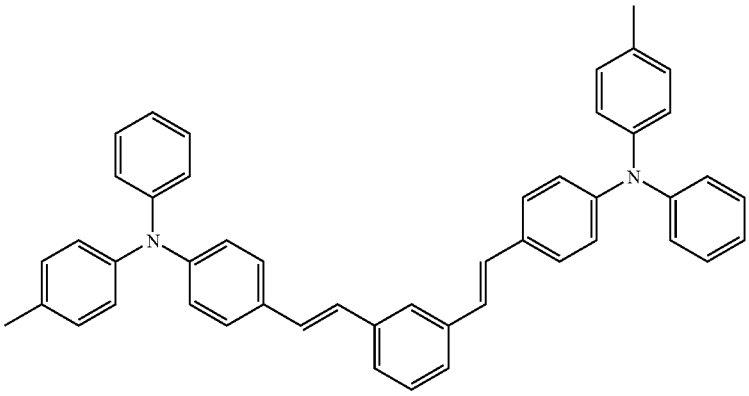

(HTM-C)
Contact Angle 90.0°

-continued
(13)
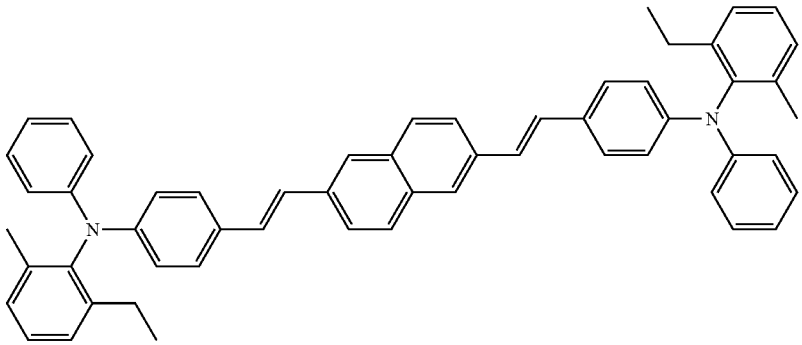
(HTM-D)
Contact Angle 89.5°
(14)
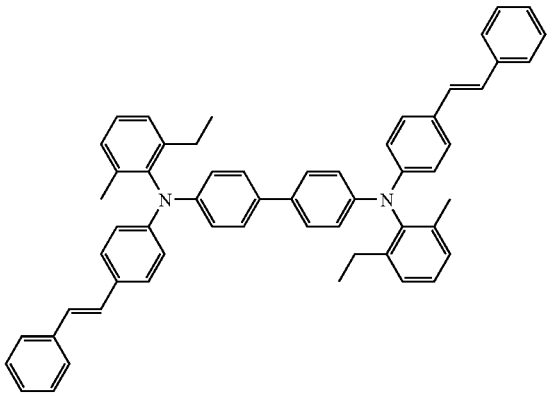
(HTM-E)
Contact Angle 91.9°
(15)
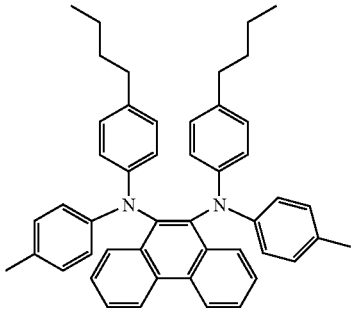
(HTM-F)
Contact Angle 95.0°
(16)
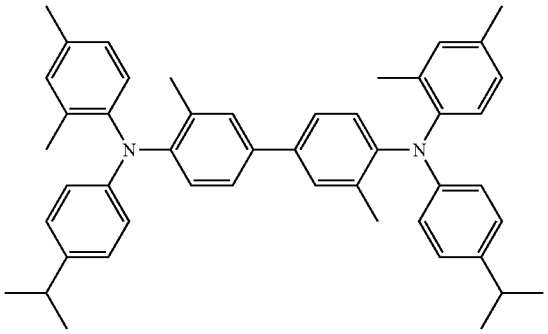
(HTM-G)
Contact Angle 97.2°
(17)
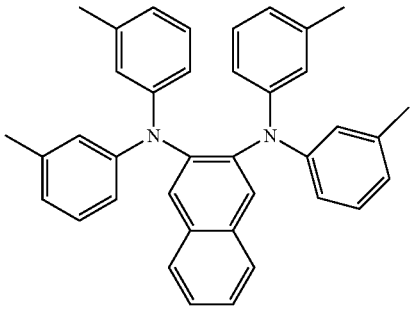
(HTM-H)
Contact Angle 94.8°

-continued (18)

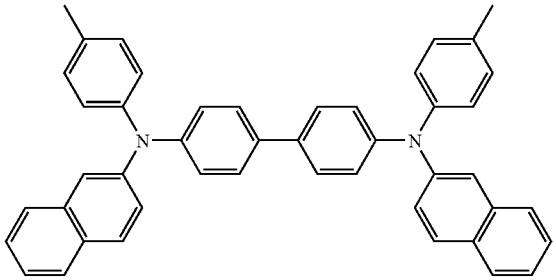

(HTM-I)
Contact Angle 90.0°

(19)

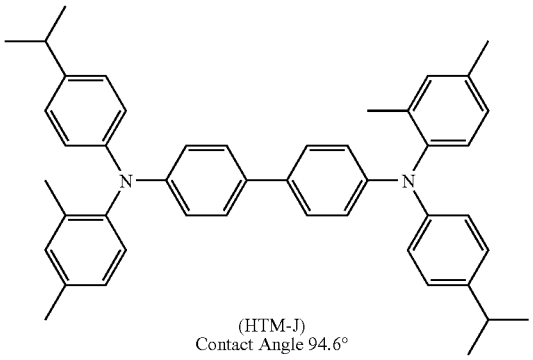

(HTM-J)
Contact Angle 94.6°

(20)

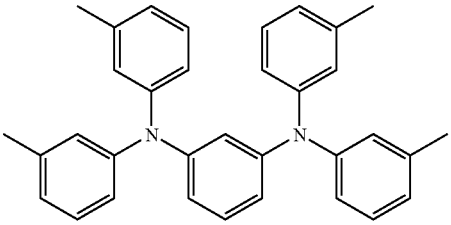

(HTM-K)
Contact Angle 92.3°

(21)

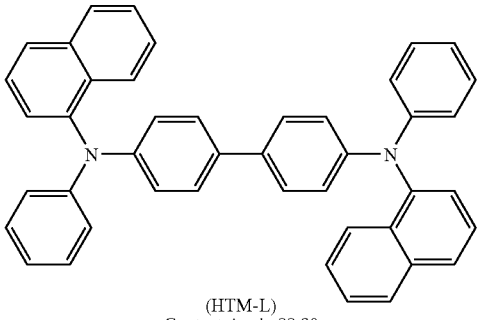

(HTM-L)
Contact Angle 88.9°

Also according to the present invention, a single use or a combination of two or more kinds of a conventionally known hole transport substance, a nitrogen containing cyclic compound such as an oxadiazole compound such as 2,5-di(4-methyl aminophenyl)-1,3,4-oxadiazole and the like, a styryl compound such as 9-(4-diethylamino styryl) anthracene or the like, a carbazole compound such as a polyvinylcarbazole and the like, an organic polysilane compound, a pyrazoline compound such as a 1-phenyl-3-(p-dimethyl aminophenyl) pyrazoline and the like, a hydrazone compound, a triphenylamine compound, an indole compound, an oxazole compound, an isoxazole compound, a thiazole compound, a thiadiazole compound, an imidazole compound, a pyrazole compound, a triazole compound and the like, a condensation polycyclic compound and the like may be named.

(3)-3 Addition Quantity

Further, it is preferable that an addition quantity of the hole transporting agent is determined by taking an addition quantity of the binding resin into consideration. To be more specific, it is preferable that the addition quantity of the hole transporting agent is set to a value which falls within a range of 10 to 100 parts by weight with respect to 100 parts by weight of the binding resin.

The reason is that, when the addition quantity of the hole transporting agent assumes a valueless than 10 parts by weight, the sensitivity of the hole transporting agent is lowered and may give rise to drawbacks in a practical use. On the other hand, when the addition quantity of the hole transporting agent exceeds 100 parts by weight, the hole transporting agent is easily crystallized and hence, there may be a case that a film which is properly used as the photoconductor cannot be formed.

Accordingly, it is more preferable to set the addition quantity of the hole transporting agent to a value which falls within a range of 20 to 80 parts by weight, and it is still more preferable to set the addition quantity of the hole transporting agent to a value which falls within a range of 30 to 60 parts by weight.

(4) Electron Transporting Agent (4)-1 Kinds

Further, it is also preferable that the single layer type electrophotographic photoconductor of the present invention further contains the electron transporting agent. As the above-mentioned electron transporting agent, compounds which include a diphenoquinone derivative and a pyrene derivative are preferably used. The reason is that, with the use of the compounds which exhibit the excellent electron reception property as the electron transporting agent, the compatibility of the photoconductor with the charge generation agent is enhanced and hence, it is possible to provide the electrophotographic photoconductor which exhibits the excellent sensitivity characteristic and solvent resistance.

(4)-2 Specific Examples

As specific examples of these electron transporting agents, compounds (ETM-A to ETM-H) represented by the following formulae (22) to (29) may be named.

(22)
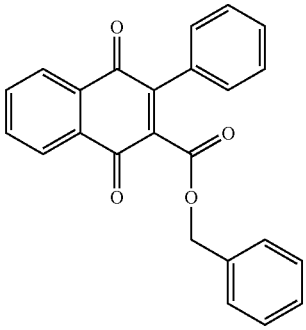
(ETM-A)
(23)
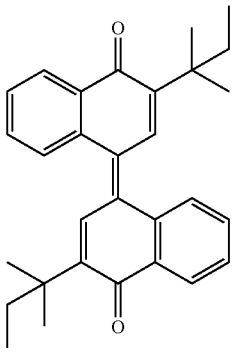
(ETM-B)
(24)
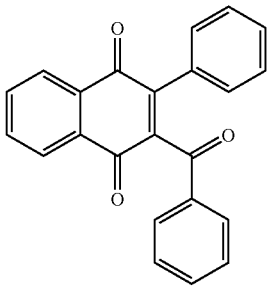
(ETM-C)
(25)
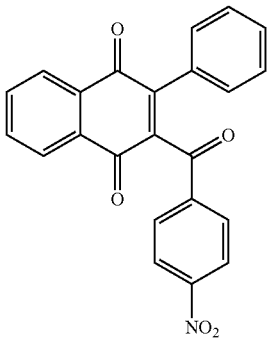
(ETM-D)
-continued
(26)
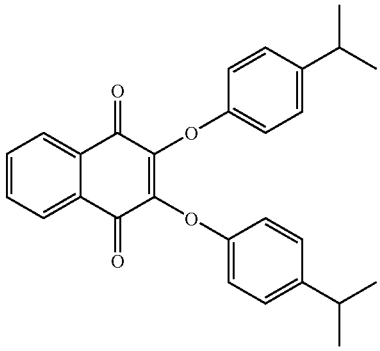
(ETM-E)
(27)
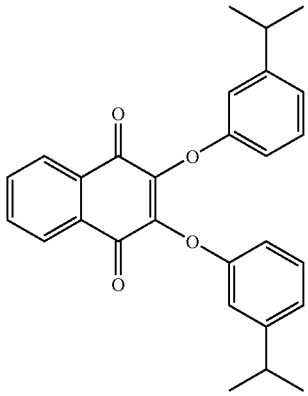
(ETM-F)
(28)
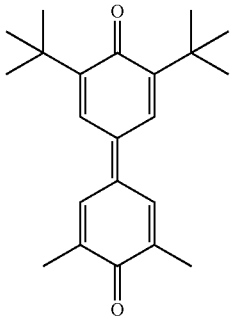
(ETM-G)
(29)
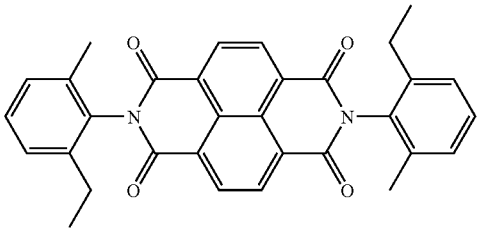
(ETM-H)

Further, as the electron transporting agents which can be used in the present invention, it is preferable to use conventionally known other electron transporting agents in combination with the above-mentioned electron transporting agents. For example, besides the benzoquinone derivative, an anthraquinone derivative, a malononitrile derivative, a thiopyran derivative, a trinitro thioxanthone derivative, a 3,4,5,7-tetranitro-9-fluorenone derivative, a dinithro anthracene derivative, a dinitro acridine derivative, a nitro anthraquinone derivative, a dinithro anthraquinone derivative, tetracyanoethylene, 2,4,8-trinitro thioxanthone, dinitro benzene, dinitro anthracene, dinitro acridine, nitro anthraquinone, dinitro anthraquinone, succinic anhydride, maleic anhydride, dibromo maleic anhydride and the like may be named and these components may be used independently in a single form or in combination.

Among these electron transporting agents, it is more preferable to use the compounds having the electron mobility of $1.0\times10^{-8}$ $cm^2/(V\cdot sec)$ or more when the field strength is $5\times10^5$ v/cm.

(4)-3 Addition Quantity

Further, it is preferable to set an addition quantity of the electron transporting agent to a value which falls within a range of 10 to 100 parts by weight with respect to 100 parts by weight of the binding resin.

The reason is that when the addition quantities of plural electron transporting agents assume a value which is below 10 parts by weight with respect to 100 parts by weight of binding resin, the sensitivity is lowered and there may arise a drawback in a practical use. On the other hand, when the addition quantities of the plural electron transporting agents assumes a value which exceeds 100 parts by weight, the electron transporting agents are easily crystallized and hence, there may be a case that a film which is proper as the photoconductor is not formed.

Accordingly, it is more preferable to set the addition quantities of the electron transporting agent to a value which falls within a range of 20 to 80 parts by weight.

Here, in determining the addition quantities of the electron transporting agents, it is preferable to take the addition quantities of the hole transporting agent into consideration. To be more specific, it is preferable to set an addition rate (total ETM/total HTM) of the electron transporting agent (total ETM) with respect to the hole transporting agent (total HTM) to a value which falls within a range of 0.25 to 1.3.

The reason is that when the rate of total ETM/total HTM assumes a value which does not fall in such a range, the sensitivity is lowered and this may give rise to a drawback in practical use.

Accordingly, it is more preferable to set the rate of total ETM/total HTM to a value which falls within a range of 0.5 to 1.25.

(5) Charge Generating Agent (5)-1 Kinds

Further, as a charge generating agent which is used in the single layer type electrophotographic photoconductor of the present invention, it is preferable that the photoconductor contains at least one compound selected from a group consisting of non-metal phthalocyanine (τ-type or X-type), titanyl phthalocyanine (α-type or Y-type), hydroxy gallium phthalocyanine (V-type), and chloro gallium phthalocyanine (II-type).

The reason is that by specifying kinds of the charge generating agent, when the hole transporting agent and the electron transporting agent are used in combination, it is possible to provide the electrophotographic photoconductor which exhibits the more excellent sensitivity characteristic, electric characteristic, stability and the like.

(5)-2 Specific Examples

Further, among these charge generating agents, to be more specific, it is more preferable to use the phthalocyanine type pigments (CGM-A to CGM-D) expressed by following formulae (30) to (33).

(30)

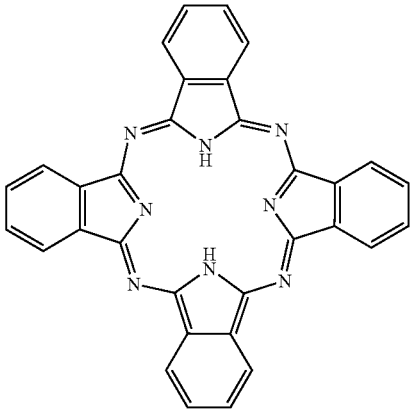

(CGM-A)

(31)

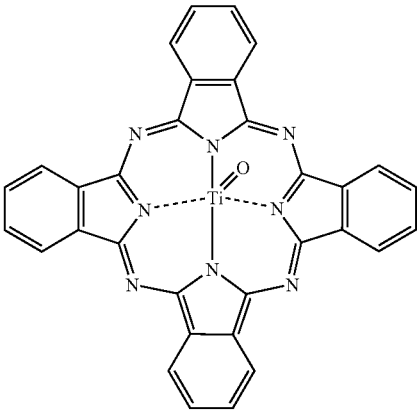

(CGM-B)

-continued (32)

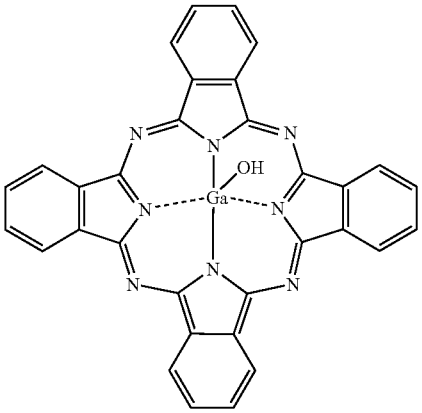

(CGM-C)

(33)

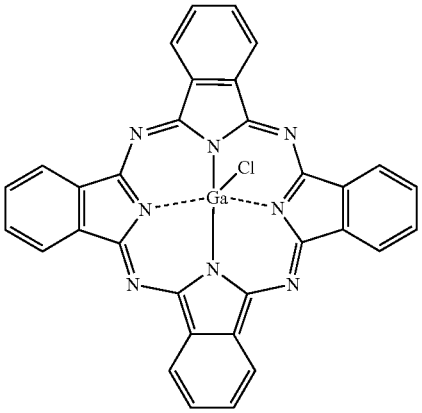

(CGM-D)

Also, it is preferable to use conventionally known charge generating agents in a single form or in combination. As kinds of such charge generating agents, single use or a combination of two or more of organic photo-conductive agents such as phthalocyanine type pigment such as oxo-titanyl phthalocyanine or the like, perilene type pigment, bis azo type pigment, dioketo-pyrrolopyrrole pigment, non-metal naphthalocyanine pigment, metal naphthalocyanine pigment, squaraine pigment, tris azo pigment, indigo pigment, azulenium pigment, cyanine pigment, pyrylium pigment, anthanthrone pigment, triphenylmethane type pigment, indanthrene pigment, toluidine type pigment, pyrazoline type pigment, quinacridone type pigment and inorganic photo-conductive agents or the like such as selenium, selenium-tellurium, selenium-arsenic, cadmium sulfide, amorphous silicon may be named.

(5)-3 Addition Quantity

Further, it is preferable to set an addition quantity of the charge generating agent to a value which falls within a range of 0.2 to 40 parts by weight with respect to 100 parts by weight of the binding resin.

The reason is that when the addition quantity of a plurality of charge generating agents assumes a value below 0.2 parts by weight, it is difficult to obtain a sufficient quantum yield and hence, it is difficult to enhance the sensitivity, the electric characteristic, the stability and the like of the electrophotographic photoconductor. On the other hand, when the addition quantity of the plurality of charge generating agents assumes a value which exceeds 40 parts by weight, an effect to increase the extinction coefficient with respect to light having a wavelength which falls in a red radiation region, a near infrared radiation region or an infrared radiation region in a visible light becomes insufficient and hence, there may arise a case in which the sensitivity characteristic, the electric characteristic, the stability and the like of the photoconductor cannot be enhanced.

Accordingly, it is more preferable that the addition quantity of the charge generating agent is set to a value which falls within a range of 0.5 to 20 parts by weight with respect to 100 parts by weight of the binding resin.

(6) Additive

Further, it is more preferable that the photoconductive layer contains at least one compound selected from a group consisting of compounds expressed by following general formulae (1) to (4) as an additive.

The reason is that with the use of the compounds having such structures as the additive, it is possible to suppress the generation of cracks on the surface of the photoconductor attributed to the adhesion of contaminants whereby it is possible to prevent the generation of black spots and fogging on an image.

That is, the single layer type electrophotographic photoconductor of the present invention is characterized by using the water-repellant polycarbonate resin as the binding resin in the photoconductor as well as by setting the contact angle of pure water with respect to the photoconductive layer to the value which falls within the given range and hence, the present invention already overcomes the drawbacks on the generation of black spots or the like attributed to the filming. Accordingly, by preventing the generation of black spots, the fogging or the like attributed to the cracks with the use of the additive, it is possible to further enhance the image characteristic.

Further, as specific additives, it is preferable to use compounds (additive-A to additive-N and additive-O-1 to additive-O-17) which are expressed by following formulae (34) to (48).

(34)

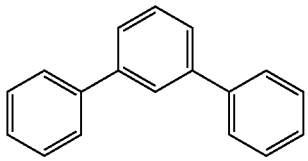

(Additive-A)

(35)

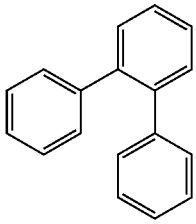

(Additive-B)

(36)

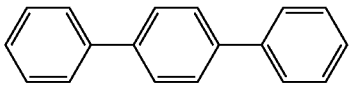

(Additive-C)

-continued
(37)
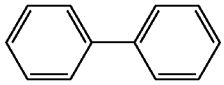
(Additive-D)
(38)
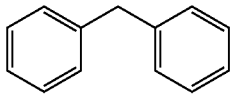
(Additive-E)
(39)
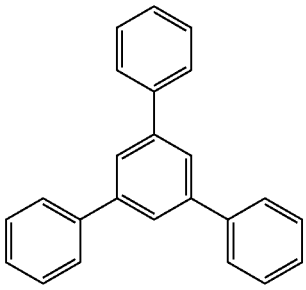
(Additive-F)
(40)
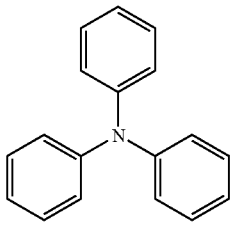
(Additive-G)
(41)
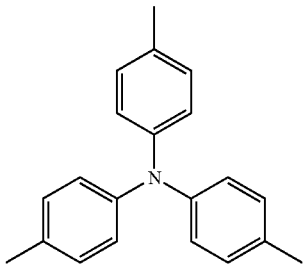
(Additive-H)
(42)
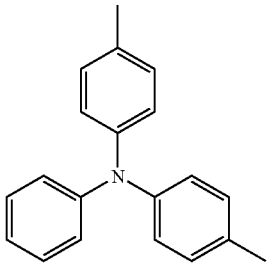
(Additive-I)
-continued
(43)
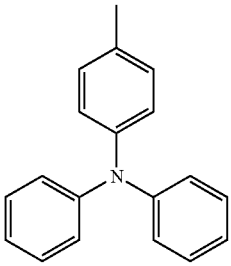
(Additive-J)
(44)
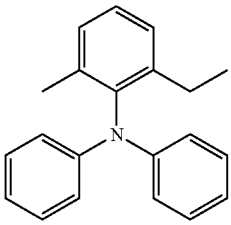
(Additive-K)
(45)
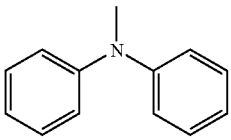
(Additive-L)
(46)
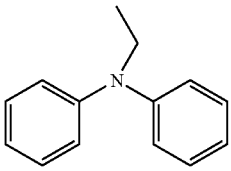
(Additive-M)
(47)
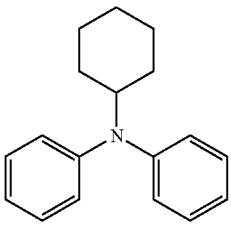
(Additive-N)

-continued (48)

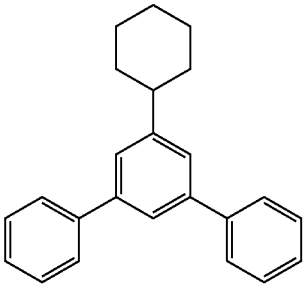

(Additive-O-1)

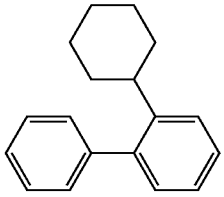

(Additive-O-2)

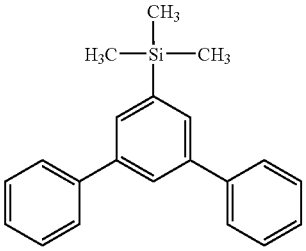

(Additive-O-3)

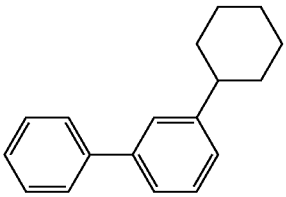

(Additive-O-4)

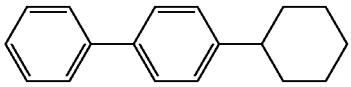

(Additive-O-5)

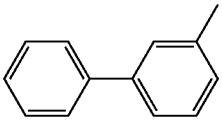

(Additive-O-6)

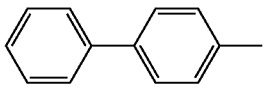

(Additive-O-7)

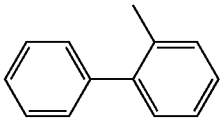

(Additive-O-8)

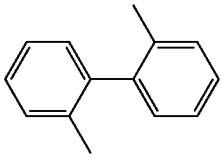

(Additive-O-9)

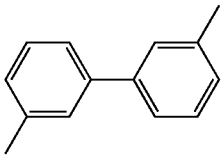

(Additive-O-10)

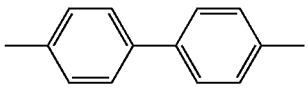

(Additive-O-11)

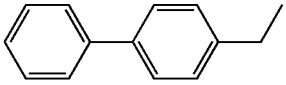

(Additive-O-12)

-continued

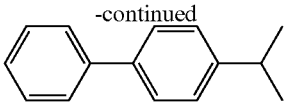

(Additive-O-13)

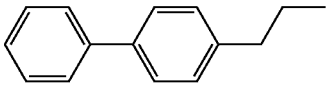

(Additive-O-14)

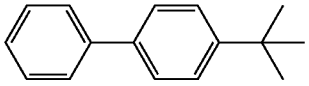

(Additive-O-15)

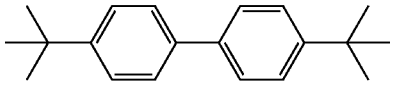

(Additive-O-16)

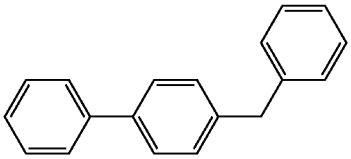

(Additive-O-17)

Here, the above-mentioned crack generation mechanism and crack suppression mechanism are explained.

First of all, when a contaminant adheres to the surface of the photoconductor, a monomer component in the photoconductive layer eludes. As a result, open pores are formed in the binding resin which constitutes the photoconductive layer. Here, a local stress is easily generated in the open-pore portion and hence, a crack which is a mechanical loss is generated in the surface of the photoconductive layer.

On the other hand, with the use of the above-mentioned compounds expressed by the general formulae (1) to (4) as additives, it is possible to release the local stress which is generated in the open-pore portion due to the elusion of the monomer component and hence, it is possible to suppress the generation of cracks.

Further, it is preferable that a content of the additive is set to a value which falls within a range of 1.5 to 15 weight % with respect to a total weight of the photoconductive layer.

The reason is that when the content assumes a value below 1.5 weight %, it is impossible to obtain the above-mentioned stress alleviation effect sufficiently and hence, it is impossible to sufficiently prevent the generation of cracks. On the other hand, when the content assumes a value which exceeds 15 weight %, a glass transition point of the photoconductive layer is lowered thus giving rise to the lowering of the wear resistance. Further, the dispersion property of the additive in the binding resin is lowered giving rise to the crystallization of the additive.

That is, by setting the content to the value which falls within such a range, it is possible to obtain the crack resistance of the photoconductive layer without increasing the molecular weight of the binding resin and hence, it is possible to provide the photoconductor which also exhibits the excellent productivity.

Accordingly, it is more preferable to set the content of the additive to a value which falls within the range of 2 to 12 weight % with respect to the total weight of the photoconductive layer, and it is still more preferable to set the content of the additive to a value which falls within the range of 3 to 10 weight % with respect to the total weight of the photoconductive layer.

(7) Other Additives

Further, besides the above-mentioned respective components, various conventionally-known additives, for example, an antioxidant, a radical supplement agent, a single quencher, a degradation inhibitor such as an ultraviolet ray absorbing agent, a tenderizer, a plasticizer, a surface reforming agent, an extending agent, a thickener, a dispersion stabilizer, a wax, an acceptor, a donor or the like can be mixed to the photoconductive layer within ranges which do not adversely influence electrophotographic characteristic. Further, for enhancing the sensitivity of the photoconductive layer, for example, known sensitizer such as terphenyl, halo naphthoquinone group or acenaphthylene is used together with the charge generating agent.

(8) Contact Angle

Further, this embodiment is characterized in that the contact angle of pure water with respect to the photoconductive layer (measured temperature: 25° C.) is set to 100° or more.

The reason is that it is possible to provide the single layer type electrophotographic photoconductor which generates the small number of black spots even when the addition quantity of the hole transporting agent is increased for enhancing the sensitivity, even when the polarity of the hole transporting agent is enhanced, or even when the photoconductor drum is rotated at a high speed.

Figure 3:
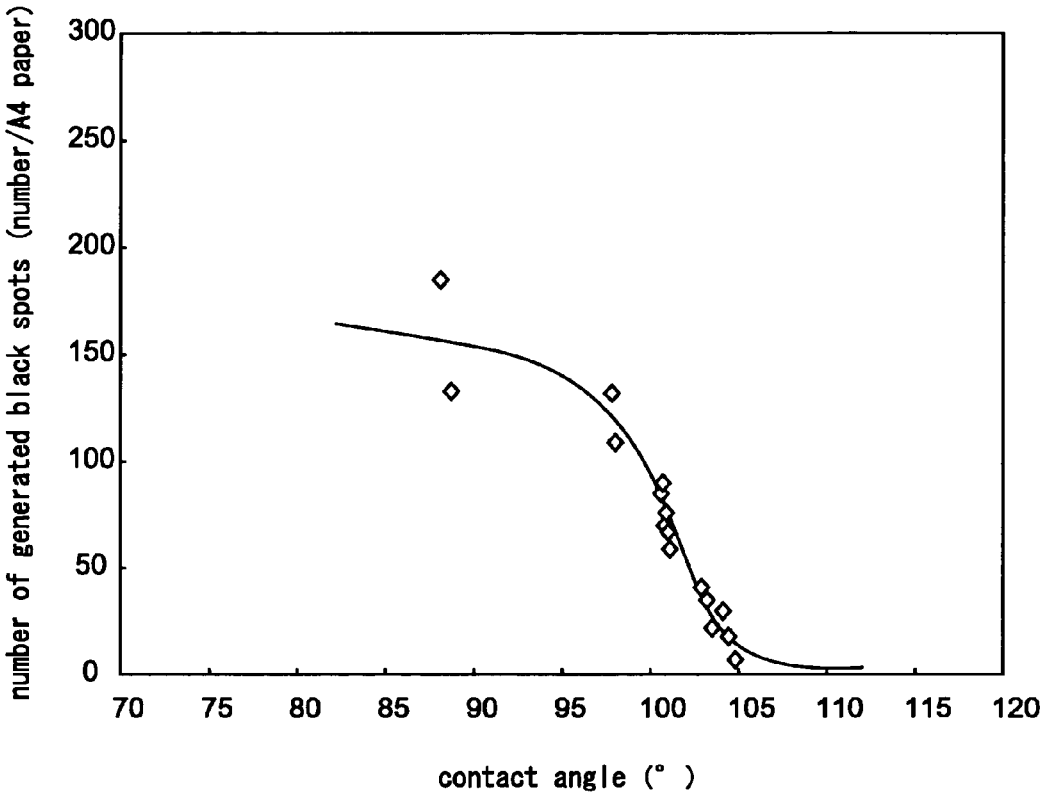
FIG. 3 is a view for explaining the relationship between the contact angle of pure water with respect to the photoconductor and the generation of black spots.

Here, the relationship between the contact angle of the electrophotographic photoconductor and the number of generated black spots per unit area is explained in conjunction with FIG. 3. In FIG. 3, the contact angle (°) of a surface of the electrophotographic photoconductor is taken on an axis of abscissas, while the number of generated black spots per sheet of A4 paper (number/A4 paper) is taken on an axis of ordinate.

As can be easily understood from FIG. 3, when the contact angle with respect to the photoconductive layer of the electrophotographic photoconductor becomes 100° or more, the number of the generated black spots becomes 90 or less (pieces/A4 paper) and hence, it is understood that the black spots are efficiently decreased. Accordingly, by controlling the contact angle of the binding resin to the given value or more, it is considered that even when the hole transporting agent having the high polarity is used, it is possible to efficiently decrease the generation of the black spots eventually.

Here, when the contact angle of the electrophotographic photoconductor with respect to the photoconductive layer becomes excessively large, there may arise a case in which kinds of selectable water-repellant polycarbonate resins or the like become excessively small.

Accordingly, it is preferable to set the contact angle of pure water with respect to the photoconductive layer to a value which falls within a range of 102° to 120°. It is further preferable to set the contact angle of pure water with respect to the photoconductive layer to a value which falls within a range of 103° to 110°.

(9) Structure (9)-1 Photoconductive Layer

Further, a thickness of the photoconductive layer in the single layer type photoconductor is usually set to a value which falls within a range of 5 to 100 μm and, preferably, within a range of 10 to 50 μm.

(9)-2 Base Body

Then, as a base body on which the photoconductive layer is formed, various materials can be used. For example, metal such as iron, aluminum, copper, tin, platinum, silver, vanadium, molybdenum, chromium, cadmium, titanium, nickel, palladium, indium, stainless steel or brass, a plastic material to which the above-mentioned metal is vapor-deposited or laminated, a glass which is covered with aluminum iodide, tin oxide, indium oxide or the like or a plastic material which is formed by dispersing electrically conductive fine articles such as carbon black therein may be named.

Further, the base body may have any shapes such as a sheet-like shape or a drum-like shape which conform to the structure of an image forming device to be used. It is sufficient that the base body per se is conductive or the surface of the base body is conductive. Further, the oxidation treatment having the electrical insulation property or the like may be applied to the surface of the base body.

Further, it is preferable that the base body exhibits a sufficient mechanical strength when used. Further, in forming the photoconductive layer, a binding resin, a hole transporting agent, an electron transporting agent and a charge generating agent are dispersed and mixed together with the suitable solvent using, for example, a roll mill, a ball mill, an atliter, a paint shaker, an ultrasonic dispersion machine or the like and, thereafter, the mixture is applied and dried.

Further, with respect to the constitution of the single layer type photoconductor, as shown in FIG. 1(*b*), it is possible to use a single layer type photoconductor 10' in which a barrier layer 16 is formed between the base body 12 and the photoconductive layer 14 provided that the characteristic of the photoconductor is not impeded.

(9)-3 Drum Diameter

Further, it is preferable to set the drum diameter (diameter of the base body) of the photoconductor to 30 mm or less.

The reason is that with the use of the single layer type electrophotographic photoconductor according to the present invention, even when the drum diameter is set to 30 mm or less, it is possible to prevent the generation of the black spots attributed to the filming on the photoconductor surface and hence, it is possible to realize the miniaturization of the image forming device.

To be more specific, by setting the drum diameter to 30 mm or below, compared to a case in which a photoconductor having a larger drum diameter is used, a rotational speed of the photoconductor for forming the same number of images is increased. As a result, the filming is more easily formed on the surface of the photoconductor.

However, even when the drum diameter is set to 30 mm or less, the single layer type electrophotographic photoconductor of the present invention is characterized in that the photoconductor contains the water repelling polycarbonate resin as the binding resin and, at the same time, the contact angle of pure water with respect to the photoconductive layer is set to the given value or more and hence, it is possible to prevent the generation of such filming.

Further, by setting the drum diameter to 30 mm or less, the curvature of the photoconductive layer is increased and hence, stress which is applied to the photoconductive layer is increased whereby cracks are easily generated.

However, even when the drum diameter is set to 30 mm or less, by adding the compounds represented by the above-mentioned general formulae (1) to (4) to the photoconductive layer, it is possible to prevent the generation of the cracks.

Accordingly, it is more preferable that the drum diameter is set to a value which falls within a range of 10 to 28 mm, and it is still more preferable that the drum diameter is set to a value which falls within a range of 15 to 25 mm.

Second Embodiment

Second embodiment is directed to an image forming device which is characterized in that the image forming device includes the single layer type electrophotographic photoconductor (hereinafter, occasionally simply referred to as a photoconductor) of the first embodiment, arranges a charging step, an exposure step, an developing step and a transferring step respectively around the electrophotographic photoconductor, and performs the image forming.

Figure 4:
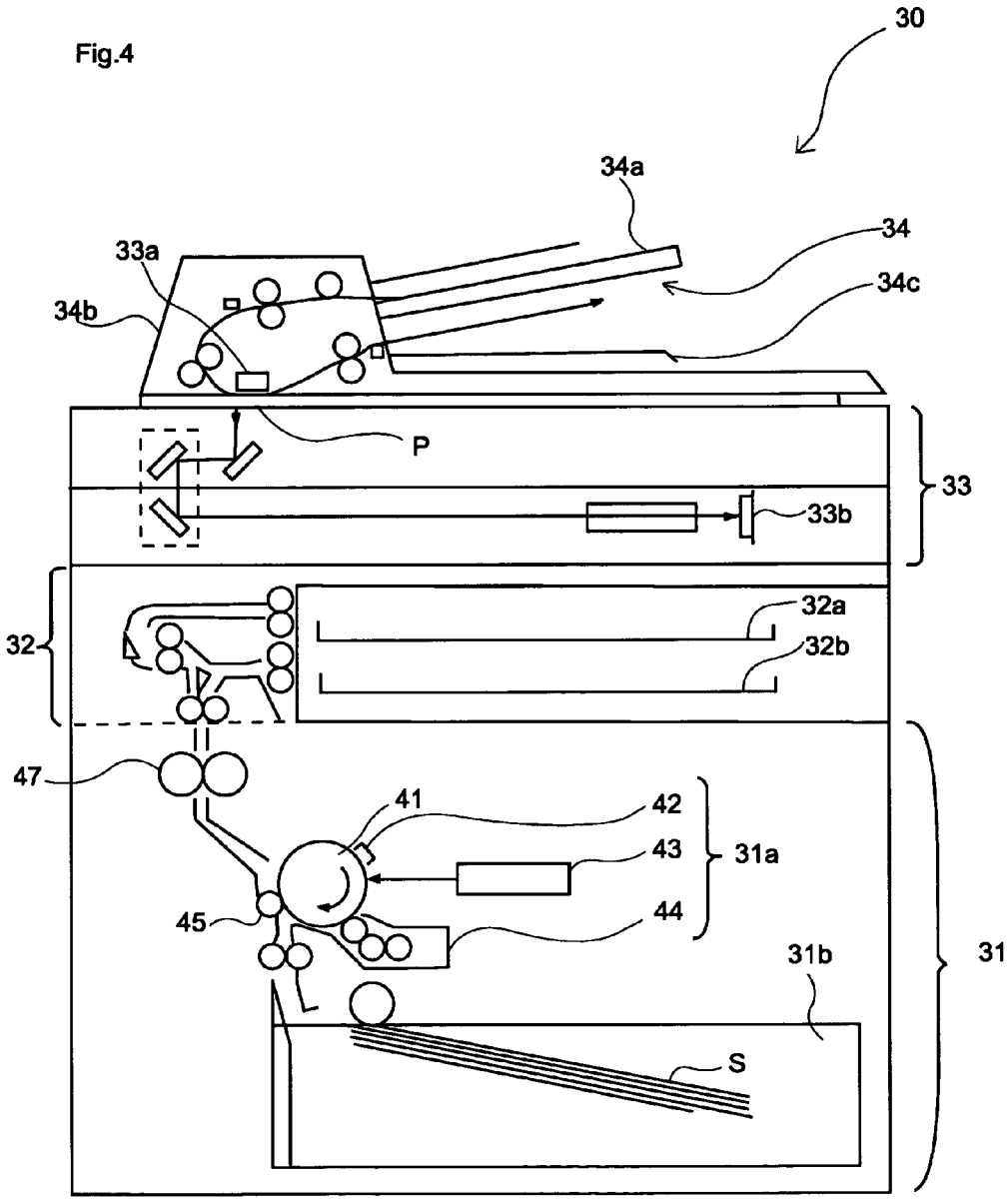
FIG. 4 is a view for explaining an image forming device which has an electrophotographic photoconductor thereon.

In carrying out the image forming method of the second embodiment, a copying machine 30 which constitutes an image forming device as shown in FIG. 4 is favorably used. The copying machine 30 includes an image forming unit 31, a paper ejection unit 32, an image reading unit 33 and an original feeding unit 34. Further, an image forming portion 31*a* and a paper feeding portion 31*b* are further provided to the image forming unit 31. Further, in the example illustrated in the drawing, the paper feeding unit 34 includes a paper storing tray 34*a*, a paper feeding mechanism 34*b* and a paper supplying tray 34*c*, wherein the papers which are placed on the paper storing tray 34*a* are transferred to an image reading position P using the paper feeding mechanism 34*b* and, thereafter, is ejected to the paper supplying tray 34*c*.

Then, in a stage at which the papers are transferred to the paper reading position P, in the image reading unit 33, an image on the papers is read out using light from a light source 33*a*. That is, using an optical element 33*b* such as a CCD, an image signal corresponding to the image on the papers is formed.

On the other hand, recording sheets (hereinafter simply referred to as sheets) S which are stored on the paper feeding portion 31*b* are transferred one by one to the image forming portion 31*a*. A photoconductor drum 41 which constitutes an image carrier is provided to the image forming portion 31*a* and, further, a charger 42, an exposure device 43, a developer 44 and a transfer roller 45 are arranged along the rotation direction of the photoconductor drum 41.

Out of these constitutional parts, the photoconductor drum 41 is rotationally driven in the direction indicated by a solid arrow in the drawing and a surface thereof is uniformly charged using the charger 42. Thereafter, in response to the above-mentioned image signal, an exposure process is performed with respect to the photoconductor drum 41 using the exposure device 43 and an electrostatic latent image is formed on the surface of this photoconductor drum 41.

Based on the electrostatic latent image, toner is adhered to the photoconductor drum 41 and is developed by the developer 44 whereby a toner image is formed on the surface of the photoconductor drum 41. Then, the toner image is transferred to the sheet S which is carried to a nip portion between the photoconductor drum 41 and the transfer roller 45 as a transferred image. Next, the sheet S having the transferred image is carried to a fixing unit 47 and, thereafter, a fixing process is performed.

Here, as a photoconductor drum 41, it is preferable to use the electrophotographic photoconductor which is explained in conjunction with the first embodiment.

Further, although the sheet S after fixing is expected to be carried to the paper ejection unit 32, in performing a post treatment (for example, stapling or the like), the post treatment is performed after the sheet S is carried to an intermediate tray 32*a*. Thereafter, the sheet S is ejected on the ejection tray portion (not shown in the drawing) which is provided on a side surface of the image forming device. On the other hand, when the post treatment is not performed, the sheet S is ejected on a paper ejection tray 32*b* provided on a lower side of the intermediate tray 32*a*. Here, the intermediate tray 32*a* and the paper ejection tray 32*b* are constituted as a so-called housed paper ejection part.

Further, in the image forming device according to the present invention, it is preferable that the development step adopts a simultaneous developing and cleaning system. That is, the simultaneous developing and cleaning system means a transferring-system image forming device which adopts a cleaner-less system in which a cleaning device is omitted and toner which remains on the photoconductor after transferring is collected by a developing device which constitutes a developing step unit in a developing step of the photoconductor and is recycled.

Usually, in the image forming device which adopts such a cleaner-less system, it is difficult to completely collect paper powder and silica or the like and there exists a case in which the adhesion of the paper powder and silica to the photoconductor is comparatively increased and hence, there easily arises a drawback that black spots and black stripes are easily generated. However, the image forming device according to the present invention has the single layer type electrophotographic photoconductor having the given contact angle therein and hence, even when the developing step adopts the simultaneous developing and cleaning system, it is possible to effectively prevent the generation of filming. Accordingly, it is possible to provide the image forming device which realizes the miniaturization, the reduction of weight, the reduction of cost and the like.

Further, in the image forming device according to the present invention, it is preferable that the drum rotational speed of the photoconductor is set to 100 mm/sec or more.

By setting such a drum rotational speed, a load applied to the paper in a transport path is increased and hence, the paper powder is easily generated. Accordingly, there arises a drawback that the adhesion of the paper powder to the photoconductor is increased and the black spots and the black stripes are easily generated on an image. However, since the image forming device has the single layer type electrophotographic photoconductor having the given contact angle therein, even when the drum rotational speed of the photoconductor is set to 100 mm/sec or more, it is possible to effectively prevent the generation of the filming and hence, the generation of the black spots and the like on the image can be suppressed. Accordingly, it is possible to provide the image forming device which enables the speedup of the image formation.

Figure 5:
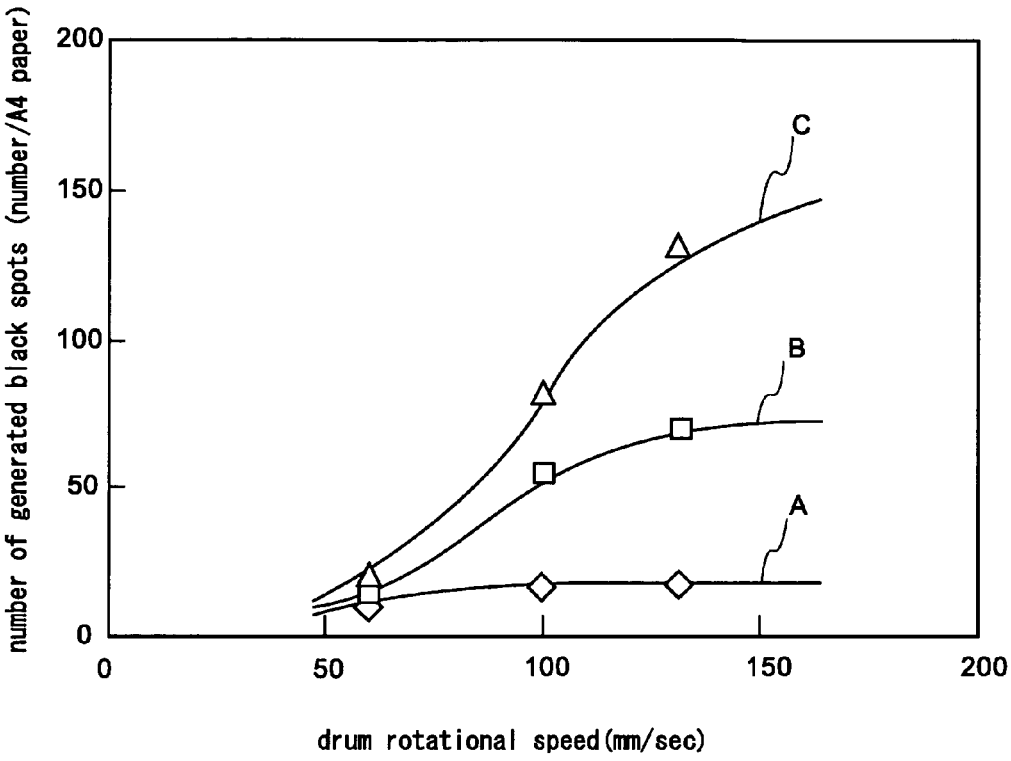
FIG. 5 is a view for explaining the relationship between a rotational speed of a photoconductor drum and the generation of black spots.

Here, the relationship between the drum rotational speed of the photoconductor and the number of the black spots is explained in conjunction with FIG. 5. In FIG. 5, a drum rotational speed (mm/sec) of the photoconductor is taken on an axis of abscissas, while the number of generated black spots per sheet of A4 paper (number/A4 paper) is taken on an axis of ordinate. Symbols A to C in the drawing indicate characteristic curves which respectively correspond to the photoconductors of the examples 1, 3 and a comparison example 1.

As can be understood from FIG. 5, when the drum rotational speed of the photoconductors is 60 (mm/sec), no substantial difference is found among the numbers of black spots which are adhered to the photoconductors A to C, while when the drum rotational speed of the photoconductors exceeds 100 (mm/sec), the big difference is found among the numbers of black spots which are adhered to the photoconductors A to C. With respect to the photoconductor C, it is found that along with the increase of the drum rotational speed, the number of black spots is also increased, and the increase of the number of black spots is continued even when the drum rotational speed becomes 100 (mm/sec) or more. On the other hand, with respect to the photoconductors A and B, it is found that even when the drum rotational speed is increased, the numbers of black spots are not substantially changed, and the increase of the number of black spots when the drum rotational speed becomes 100 (mm/sec) or more is relatively small. That is, it is found that the photoconductors A and B exhibit the relatively small number of black spots even when the drum rotational speed becomes 100 (mm/sec) or more.

Accordingly, it is more preferable that the drum rotational speed of the photoconductor is set to a value which falls within a range of 100 to 200 mm/sec. The reason is that when the drum rotational speed is 200 mm/sec or more, a load applied to paper becomes excessively large and hence, there may arise a problem in the transferring of the paper or the like.

EXAMPLE

Example 1

1. Preparation of Electrophotographic Photoconductor 4 parts by weight of X type non-metal phthalocyanine (CGM-A) represented by formula (30) as the charge generating agent, 50 parts by weight of a stilbene derivative (HTM-A) represented by formula (10) as a hole transporting agent, 30 parts by weight of a naphthoquinone derivative (ETM-A) represented by formula (22) as an electron transporting agent, 100 parts by weight of a polycarbonate resin (Resin-A) represented by formula (6) having a viscosity average molecular weight of 20,000 as a binding resin, and 800 parts by weight of tetrahydrofuran as a solvent are filled in a vessel.

Next, the contents of the vessel are mixed and dispersed using a ball mill for 50 hours thus preparing a coating liquid to be applied to the single layer type photoconductive layer. The prepared coating liquid is applied to a base body (an aluminum stock tube) having a diameter of 30 mm using a dip coating method and is dried with hot air of 100° C. for 40 minutes thus producing the electrophotographic photoconductor having a single layer type photoconductive layer having a film thickness of 25 μm.

2. Evaluation of Electrophotographic Photoconductor and Resin Film (1) Measurement of Contact Angle of Water-repellant Polycarbonate Resin A resin film is formed and a contact angle of water-repellant polycarbonate resin is measured. That is, 25 parts by weight of a resin (resin-A) having a viscosity average molecular weight of 20,000 represented by formula (6) and 75 parts by weight of tetrahydrofuran are mixed for 24 hours thus preparing a coating liquid. The prepared coating liquid is applied to an aluminum stock tube having a diameter of 30 mm using a dip coating method and is dried with hot air at 100° C. for 40 minutes thus producing a resin film having a film thickness of 25 μm. A contact angle of the resin film with respect to pure water is measured (measured temperature: 25° C.) using a contact angle meter (made by Kyowa Interface Science Co. Ltd., FACE-CONTACT-ANGLE METER) by a liquid drop method. The obtained result is shown in Table 1.

(2) Measurement of Contact Angle of Hole Transporting Agent

Next, a resin film made of hole transporting agent is formed and a contact angle is measured. That is, 43 parts by weight of a compound (HTM-A) represented by formula (10), 100 parts by weight of a Z-type polycarbonate resin (TS2020, made by Teijin Chemical Ltd.) having a viscosity average molecular weight of 20,000, 0.1 parts by weight of dimethyl polysiloxane (KF-90, 50 cps, made by Shin-Etsu Chemical Co. Ltd.), and 800 parts by weight of tetrahydrofuran are mixed for 24 hours thus preparing a hole-transport-agent resin dispersion solution. The obtained solution is applied to an aluminum stock tube using a dip coating method and is dried with hot air of 100° C. for 40 minutes whereby a hole-transport-agent resin dispersion film having a film thickness of 25 μm is obtained. A contact angle of the hole-transport-agent resin dispersion film with respect to pure water is measured (measured temperature: 25° C.) using the contact angle meter (made by Kyowa Interface Science Co. Ltd., FACE-CONTACT-ANGLE METER) by the liquid drop method. The obtained result is shown in Table 1.

(3) Measurement of Contact Angle in Photoconductive Layer of Electrophotographic Photoconductor The contact angle of the photoconductive layer of the electrophotographic photoconductor obtained in the paragraph 1, with respect to pure water is measured (measured temperature: 25° C.) using the contact angle meter (made by Kyowa Interface Science Co. Ltd., FACE-CONTACT-ANGLE METER) by the liquid drop method. The obtained result is shown in Table 1.

(4) Measurement of Number of Generated Black Spots

Next, the obtained electrophotographic photoconductor is provided on a remodeled machine of a printer Actico 40 made by Kyocera Mita Corporation which exhibits a drum rotational speed of 140 nm/sec and 5,000 sheets of A4 papers (high-quality PPC paper made by Fuji Xerox Manufacturing Co. Ltd.) are continuously printed under an environmental condition of 40° C. and 90% Rh. Thereafter, after leaving the printer for 6 hours, an A4 blank original paper is printed and the number of generated black spots which are generated on the A4 paper is counted and, at the same time, is evaluated in accordance with following criteria.

E: Number of generated black spots is less than 50 per sheet of A4 paper.

G: Number of generated black spots is not less than 50 and less than 80 per sheet of A4 paper.

F: Number of generated black spots is not less than 80 and less than 130 per sheet of A4 paper.

B: Number of generated black spots is not less than 130 per sheet of A4 paper.

Examples 2 to 4

In the examples 2 to 4, as shown in Table 1, single layer type photoconductors are formed in the same manner as the example 1 except for that, in place of the binding resin (Resin-A) used in the example 1, binding resins (Resin-B to D) represented by formulae (7) to (9) respectively having a viscosity average molecular weight of 20,000 are added to the photoconductors respectively and are evaluated. The obtained results are shown in Table 1.

Examples 5 to 8

In examples 5 to 8, as shown in Table 1, single layer type photoconductors are formed in the same manner as the examples 1 to 4 except for that, in place of the hole transporting agent (HTM-A) used in the examples 1 to 4, a hole transporting agent (HTM-E) represented by formula (14) is used and are evaluated. The obtained results are shown in Table 1.

Examples 9 to 12

In the examples 9 to 12, as shown in Table 1, single layer type photoconductors are formed in the same manner as the examples 1 to 4 except for that, in place of the hole transporting agent (HTM-A) used in the examples 1 to 4, a hole transporting agent (HTM-B) represented by formula (11) is used and are evaluated. The obtained results are shown in Table 1.

Comparison Examples 1 to 2

In the comparison examples 1 to 2, as shown in Table 1, single layer type photoconductors are formed in the same manner as the example 1 except for that, in place of the binding resin (Resin-A) used in the example 1, binding resins represented by formula (49) to (50) respectively having a viscosity average molecular weight of 20,000 are respectively added to the photoconductor and are evaluated. The obtained results are shown in Table 1.

(49)

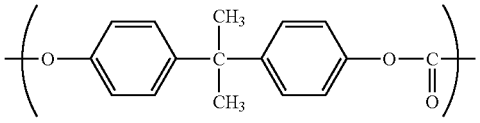

(Resin-E)

[0150]

(50)

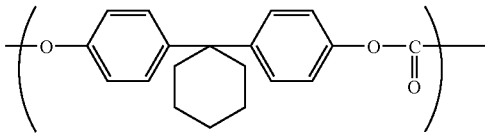

(Resin-F)

Comparison Examples 3 to 4

In the comparison examples 3 to 4, as shown in Table 1, single layer type photoconductors are formed in the same manner as the example 1 except for that, in place of the hole transporting agent (HTM-A) used in the example 1, a hole transporting agent (HTM-E) represented by formula (14) is used and, further, in place of the binding resin (Resin-A), binding resins (Resin-E to F) represented by formula (49) to (50) respectively having a viscosity average molecular weight of 20,000 are added to the photoconductor respectively and are evaluated. The obtained result is shown in Table 1.

Example 13

In the example 13, as shown in Table 2, a single layer type electrophotographic photoconductor is formed in the same manner as the example 1 except for that the obtained coating liquid for photoconductive layer is applied to an aluminum stock tube having a diameter of 24 mm in place of the aluminum stock tube having the diameter of 30 mm used in the example 1 and is evaluated.

Examples 14 to 16

In the examples 14 to 16, as shown in Table 2, single layer type photoconductors are formed in the same manner as the example 13 except for that, in place of the binding resin (Resin-A) used in the example 13, binding resins (Resin-B to D) represented by formula (7) to (9) respectively having a viscosity average molecular weight of 20,000 are respectively added to the photoconductors and are evaluated. The obtained results are shown in Table 2.

Examples 17 to 20

In the examples 17 to 20, as shown in Table 2, single layer type photoconductors are formed in the same manner as the examples 13 to 16 except for that, in place of the hole transporting agent (HTM-A) used in the examples 13 to 16, the hole transporting agent (HTM-E) represented by formula (14) is used and are evaluated. The obtained results are shown in Table 2.

Examples 21 to 24

In the examples 21 to 24, as shown in Table 2, single layer type photoconductors are formed in the same manner as the examples 13 to 16 except for that, in place of the hole transporting agent (HTM-A) used in the examples 13 to 16, the hole transporting agent (HTM-B) represented by formula (11) is used and are evaluated. The obtained results are shown in Table 2.

Comparison Examples 5 to 6

In the comparison examples 5 to 6, as shown in Table 2, single layer type photoconductors are formed in the same

TABLE 1

| | Binding Resin | | Hole Transport Agent | | Contact Angle | | Number of Generated Black | Evaluation of |
|---|---|---|---|---|---|---|---|---|
| | Kinds | Contact Angle (°) | Kinds | Contact Angle (°) | of Photoconductor (°) | Drum Diameter (mm) | Spots (Number/A4 Paper) | Number of Generated Black Spots |
| Example 1 | Resin-A | 103.7 | HTM-A | 90.2 | 104.4 | 30 | 18 | E |
| Example 2 | Resin-B | 102.5 | HTM-A | 90.2 | 103.2 | 30 | 35 | E |
| Example 3 | Resin-C | 100.4 | HTM-A | 90.2 | 100.8 | 30 | 70 | G |
| Example 4 | Resin-D | 100.5 | HTM-A | 90.2 | 100.9 | 30 | 76 | G |
| Example 5 | Resin-A | 103.7 | HTM-E | 91.9 | 104.8 | 30 | 7 | E |
| Example 6 | Resin-B | 102.5 | HTM-E | 91.9 | 103.5 | 30 | 22 | E |
| Example 7 | Resin-C | 100.4 | HTM-E | 91.9 | 101.0 | 30 | 67 | G |
| Example 8 | Resin-D | 100.5 | HTM-E | 91.9 | 101.1 | 30 | 59 | G |
| Example 9 | Resin-A | 103.7 | HTM-B | 88.0 | 104.1 | 30 | 30 | E |
| Example 10 | Resin-B | 102.5 | HTM-B | 88.0 | 102.9 | 30 | 41 | E |
| Example 11 | Resin-C | 100.4 | HTM-B | 88.0 | 100.6 | 30 | 85 | F |
| Example 12 | Resin-D | 100.5 | HTM-B | 88.0 | 100.7 | 30 | 90 | F |
| Comparison Ex. 1 | Resin-E | 97.0 | HTM-A | 90.2 | 97.8 | 30 | 132 | B |
| Comparison Ex. 2 | Resin-F | 87.1 | HTM-A | 90.2 | 88.1 | 30 | 185 | B |
| Comparison Ex. 3 | Resin-E | 97.0 | HTM-E | 91.9 | 98.0 | 30 | 109 | B |
| Comparison Ex. 4 | Resin-F | 87.1 | HTM-E | 91.9 | 88.7 | 30 | 133 | B |

E: Excellent
G: Good
F: Fair
B: Bad manner as the example 13 except for that, in place of the binding resin (Resin-A) used in the example 13, binding resins (Resin-E to F) represented by formula (49) to (50) respectively having a viscosity average molecular weight of 20,000 are respectively added to the photoconductors and are evaluated. The obtained results are shown in Table 2.

Comparison Examples 7 to 8

In the comparison examples 7 to 8, as shown in Table 2, single layer type photoconductors are formed in the same manner as the example 13 except for that, in place of the hole transporting agent (HTM-A) used in the example 13, a hole transporting agent (HTM-E) represented by formula (14) is used and, further, in place of the binding resin (Resin-A), binding resins (Resin-E to F) represented by formula (49) to (50) respectively having a viscosity average molecular weight of 20,000 are respectively added to the photoconductors and are evaluated. The obtained results are shown in Table 2.

abrasion resistance evaluation are performed. Such evaluation methods are specifically described hereinafter.

1. Abrasion Resistance Evaluation and Crack Resistance Evaluation

With respect to a surface of the obtained photoconductor, the photoconductor is immersed in 30 g of oleic acid triglyceride which is found by a separate experiment to have the same characteristic as sebum and oil of finger which are supposed to be contamination components attributed to human body under the condition of temperature of 20° C. and humidity of 60% for 20 hours (1200 min), and the photoconductor after the immersion is washed with ethanol. Thereafter, lengths of cracks are measured using an optical microscope and growth rates per unit time are calculated. Further, based on the crack growth rates, the crack resistance of the photoconductor is evaluated in accordance with the following criteria. The respective obtained results are shown in Table 3.

TABLE 2

| | Binding Resin | | Hole Transport Agent | | Contact Angle | | Number of Generated Black | Evaluation of |
|---|---|---|---|---|---|---|---|---|
| | Kinds | Contact Angle (°) | Kinds | Contact Angle (°) | of Photoconductor (°) | Drum Diameter (mm) | Spots (Number/A4 Paper) | Number of Generated Black Spots |
| Example 13 | Resin-A | 103.7 | HTM-A | 90.2 | 104.4 | 24 | 22 | E |
| Example 14 | Resin-B | 102.5 | HTM-A | 90.2 | 103.2 | 24 | 40 | E |
| Example 15 | Resin-C | 100.4 | HTM-A | 90.2 | 100.8 | 24 | 80 | F |
| Example 16 | Resin-D | 100.5 | HTM-A | 90.2 | 100.9 | 24 | 92 | F |
| Example 17 | Resin-A | 103.7 | HTM-E | 91.9 | 104.8 | 24 | 10 | E |
| Example 18 | Resin-B | 102.5 | HTM-E | 91.9 | 103.5 | 24 | 24 | E |
| Example 19 | Resin-C | 100.4 | HTM-E | 91.9 | 101.0 | 24 | 90 | F |
| Example 20 | Resin-D | 100.5 | HTM-E | 91.9 | 101.1 | 24 | 71 | G |
| Example 21 | Resin-A | 103.7 | HTM-B | 88.0 | 104.1 | 24 | 32 | E |
| Example 22 | Resin-B | 102.5 | HTM-B | 88.0 | 102.9 | 24 | 48 | E |
| Example 23 | Resin-C | 100.4 | HTM-B | 88.0 | 100.6 | 24 | 120 | F |
| Example 24 | Resin-D | 100.5 | HTM-B | 88.0 | 100.7 | 24 | 120 | F |
| Comparison Ex. 5 | Resin-E | 97.0 | HTM-A | 90.2 | 97.8 | 24 | 180 | B |
| Comparison Ex. 6 | Resin-F | 87.1 | HTM-A | 90.2 | 88.1 | 24 | 224 | B |
| Comparison Ex. 7 | Resin-E | 97.0 | HTM-E | 91.9 | 98.0 | 24 | 150 | B |
| Comparison Ex. 8 | Resin-F | 87.1 | HTM-E | 91.9 | 88.7 | 24 | 170 | B |

E: Excellent
G: Good
F: Fair
B: Bad

Example 25

In the example 25, at the time of preparing a coating liquid for photoconductive layer, as shown in Table 3, in place of the hole transporting agent (HTM-A) used in the example 1, a hole transporting agent (HTM-E) represented by formula (14) is used. Further, an additive (additive-A) represented by formula (34) is added to the photoconductor so that the content of the additive amounts to 1.5 weight % of the total weight of the photoconductive layer. With respect to other conditions, the coating liquid for photoconductive layer is prepared in the same manner as the example 1.

Further, a single layer type electrophotographic photoconductor is prepared in the same manner as the example 1 except for that the obtained coating liquid is applied to an aluminum stock tube having a diameter of 24 mm in place of the aluminum stock tube having the diameter of 30 mm used in the example 1.

Further, as evaluations, besides the evaluation performed in the example 1, a crack growth rate measurement and an E: The crack growth rate is less than 2 (mm/min).

G: The crack growth rate is not less than 2 (mm/min) and less than 4 (mm/min).

F: The value of the crack growth rate is not less than 4 (mm/min) and less than 5 (mm/min).

B: The value of the crack growth rate is not less than 5 (mm/min).

2. Member Resistance Evaluation

A member resistance of the obtained photoconductive layer is evaluated. That is, the photoconductor is provided within a drum unit and is left under the condition of temperature of 50° C. and humidity of 80% for 10 days. After leaving the photoconductor, a gray image is outputted and stripes attributed to pressure contact flaws of the member which appear on the image are evaluated in accordance with following criteria.

G: Generation of stripes is not recognized.

F: Stripes are slightly generated.

Examples 26 to 31

In the examples 26 to 31, as shown in Table 3, except for that content of the additive (additive-A) which is used in the example 25 is changed, a single layer type photoconductor is formed in the same manner as the example 25 and is evaluated. The obtained result is shown in Table 3.

Examples 32 to 33

In the examples 32 to 33, as shown in Table 3, in place of the hole transporting agent (HTM-E) used in the example 25, a hole transporting agent (HTM-A) represented by formula (10) is used. Further, as shown in Table 3, the content of the additive (additive-A) which is used in the example 25 is changed. With respect to other conditions, single layer type photoconductors are formed in the same manner as the example 25 and are evaluated. The obtained results are shown in Table 3.

Example 34

In the example 34, as shown in Table 3, in place of the binding resin (Resin-A) used in the example 25, the binding resin (Resin-B) represented by formula (7) is used. Further, in place of the additive (additive-A) used in the example 25, an additive (additive-G) represented by formula (40) is added so that the content of the additive is 7.4 weight % based on the total weight of the photoconductive layer. With respect to other conditions, a single layer type photoconductor is formed in the same manner as the example 25 and is evaluated. The obtained result is shown in Table 3.

Examples 35 to 37

In the examples 35 to 37, as shown in Table 3, in place of the additive (additive-A) used in the example 25, additives (F), (B) and (E) respectively represented by formulae (39), (35) and (38) are added so that the contents of the additives is 4.2 weight % based on the total weight of the photoconductive layer. With respect to other conditions, single layer type photoconductors are formed in the same manner as the example 25 and are evaluated. The obtained results are shown in Table 3.

Example 38

In the example 38, as shown in Table 3, in place of the hole transporting agent (HTM-E) used in the example 25, a hole transporting agent (HTM-B) represented by formula (11) is used and the content of the additive (additive-A) is set to 4.2 weight % based on the total weight of the photoconductive layer. With respect to other conditions, a single layer type photoconductor is formed in the same manner as the example 25 and is evaluated. The obtained result is shown in Table 3.

Example 39

In the example 39, as shown in Table 3, the content of the additive (additive-A) in the example 25 is set to 1.6 weight % based on the total weight of the photoconductive layer and the obtained coating liquid for photoconductive layer is applied to an aluminum stock tube having a diameter of 30 mm in place of the aluminum stock tube having the diameter of 24 mm used in the example 25. With respect to other conditions, a single layer type photoconductor is formed in the same manner as the example 25 and is evaluated. The obtained result is shown in Table 3.

Comparison Example 9

In the comparison example 9, as shown in Table 3, in place of the binding resin (Resin-A) used in the example 25, binding resin (Resin-E) represented by formula (49) is used and the content of the additive (additive-A) is set to 2.3 weight % based on the total weight of the photoconductive layer. With respect to other conditions, a single layer type photoconductor is formed in the same manner as the example 25 and is evaluated. The obtained result is shown in Table 3.

Comparison Example 10

In the comparison example 10, as shown in Table 3, in place of the binding resin (Resin-A) used in the example 25, a binding resin (Resin-F) represented by formula (50) is used and the content of the additive (additive-A) is set to 2.3 weight % based on the total weight of the photoconductive layer. With respect to other conditions, a single layer type photoconductor is formed in the same manner as the example 25 and is evaluated. The obtained result is shown in Table 3.

TABLE 3

| | Binding Resin | | Hole Transport Agent | | Contact Angle | Additives | | | Number of Generated Black Spots | Evaluation of Resistance to Pollution | | |
|---|---|---|---|---|---|---|---|---|---|---|---|---|
| | Kinds | Contact Angle (°) | Kinds | Contact Angle (°) | of Photo-conductor (°) | Kinds | Amount of Additives (w %) | Drum Diameter (mm) | (Number/ A4 Paper) | Crack Growth Rate (mm/min) | Evaluation of Crack Resistance | Evaluation of Member Resistance |
| Ex. 25 | Resin-A | 103.7 | HTM-E | 91.9 | 104.1 | Additive-A | 1.5 | 24 | 10 | 1.70 | E | G |
| Ex. 26 | Resin-A | 103.7 | HTM-E | 91.9 | 104.4 | Additive-A | 4.2 | 24 | 10 | 1.28 | E | G |
| Ex. 27 | Resin-A | 103.7 | HTM-E | 91.9 | 105.0 | Additive-A | 7.5 | 24 | 10 | 0.51 | E | G |
| Ex. 28 | Resin-A | 103.7 | HTM-E | 91.9 | 104.4 | Additive-A | 11.8 | 24 | 11 | 0.00 | E | G |
| Ex. 29 | Resin-A | 103.7 | HTM-E | 91.9 | 106.6 | Additive-A | 15.0 | 24 | 7 | 0.00 | E | G |
| Ex. 30 | Resin-A | 103.7 | HTM-E | 91.9 | 106.3 | Additive-A | 16.2 | 24 | 7 | 0.00 | E | F |
| Ex. 31 | Resin-A | 103.7 | HTM-E | 91.9 | 106.0 | Additive-A | 17.0 | 24 | 6 | 0.00 | E | F |
| Ex. 32 | Resin-A | 103.7 | HTM-A | 90.2 | 103.2 | Additive-A | 2.3 | 24 | 24 | 1.70 | E | G |
| Ex. 33 | Resin-A | 103.7 | HTM-A | 90.2 | 103.6 | Additive-A | 8.4 | 24 | 23 | 1.15 | E | G |
| Ex. 34 | Resin-B | 102.5 | HTM-E | 91.9 | 103.2 | Additive-G | 7.4 | 24 | 25 | 0.99 | E | G |
| Ex. 35 | Resin-A | 103.7 | HTM-E | 91.9 | 102.1 | Additive-F | 4.2 | 24 | 31 | 2.10 | G | G |
| Ex. 36 | Resin-A | 103.7 | HTM-E | 91.9 | 101.2 | Additive-B | 4.2 | 24 | 37 | 1.33 | E | G |

TABLE 3-continued

| | Binding Resin | | Hole Transport Agent | | Contact Angle | Additives | | | Number of Generated Black Spots | Evaluation of Resistance to Pollution | | |
|---|---|---|---|---|---|---|---|---|---|---|---|---|
| | Kinds | Contact Angle (°) | Kinds | Contact Angle (°) | of Photo-conductor (°) | Kinds | Amount of Additives (w %) | Drum Diameter (mm) | (Number/ A4 Paper) | Crack Growth Rate (mm/min) | Evaluation of Crack Resistance | Evaluation of Member Resistance |
| Ex. 37 | Resin-A | 103.7 | HTM-E | 91.9 | 104.1 | Additive-E | 4.2 | 24 | 25 | 1.69 | E | G |
| Ex. 38 | Resin-A | 103.7 | HTM-B | 88.0 | 103.3 | Additive-A | 4.2 | 24 | 36 | 1.00 | E | G |
| Ex. 39 | Resin-A | 103.7 | HTM-E | 91.9 | 104.1 | Additive-A | 1.6 | 30 | 32 | 4.32 | F | G |
| C-Ex. 9 | Resin-E | 97.0 | HTM-E | 91.9 | 97.8 | Additive-A | 2.3 | 24 | 179 | 3.55 | G | G |
| C-Ex. 10 | Resin-F | 87.1 | HTM-E | 91.9 | 88.1 | Additive-A | 2.3 | 24 | 230 | 1.30 | E | G |

INDUSTRIAL APPLICABILITY

As has been described in detail heretofore, according to the present invention, by allowing the photoconductor to contain the water-repellant polycarbonate resin as the binding resin and, at the same time and by setting the contact angle of pure water with respect to the photoconductive layer to the value which falls within the predetermined range, it is possible to obtain the electrophotographic photoconductor which generates the small number of black spots even when the photoconductor is used for a long time and, at the same time, the image forming device which includes the electrophotographic photoconductor.

Accordingly, it is expected that the electrophotographic photoconductor according to the present invention contributes to the reduction of cost, the speedup of the operation, the enhancement of performance or the like in various types of image forming devices such as a copying machine and a printer.

What we claim is:

1. A single layer type electrophotographic photoconductor which includes a photoconductive layer containing a binding resin, a hole transporting agent and a charge generating agent, wherein the photoconductor contains as the binding resin, a water-repellent polycarbonate resin having a siloxane structure, which is present non-uniformly in a surface of the photoconductive layer, and a contact angle of pure water (measured temperature: 25° C.) with respect to the photoconductive layer is set to 100° or more.

2. The single layer type electrophotographic photoconductor according to claim 1, wherein the contact angle of the pure water (measured temperature: 25° C.) wit respect to the water-repellent polycarbonate resin is set to 98° or more.

3. The single layer type electrophotographic photoconductor according to claim 1, wherein assuming a total amount of the polycarbonate resin having the siloxane structure as 100 mol %, a content ratio of the units having the siloxane structure is set to a value which falls within a range of 0.1 to 20 mol %.

4. The single layer type electrophotographic photoconductor according to claim 1, wherein the photoconductor contains, as the hole transporting agent, a compound having the contact angle (measured temperature: 25° C.) of 90° or more with respect to the pure water in a resin dispersion film.

5. The single layer type electrophotographic photoconductor according to claim 1, wherein the photoconductor contains, as the hole transporting agent, a compound having a triphenylamine skeleton which includes the stilbene structure.

6. The single layer type electrophotographic photoconductor according to claim 1, wherein the photoconductive layer contains, as an additive, at least a compound selected from a group consisting of compounds represented by following general formulae (1) to (4):

(1)

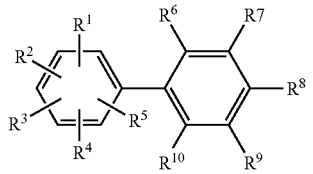

(In the general formula (1), $R^1$ to $R^{10}$ are respectively independent substituted groups and represent a hydrogen atom, a halogen atom, a substituted or unsubstituted alkyl group having 1 to 12 carbons, a substituted or unsubstituted alkoxy group having 1 to 12 carbons, a substituted or unsubstituted aryl group having 6 to 30 carbons, a substituted or unsubstituted aralkyl group having 6 to 30 carbons, a substituted or unsubstituted cycloalkyl group, a hydroxyl group, a cyano group, a nitro group, an amino group or a halogen alkyl group having 3 to 12 carbons);

(2)

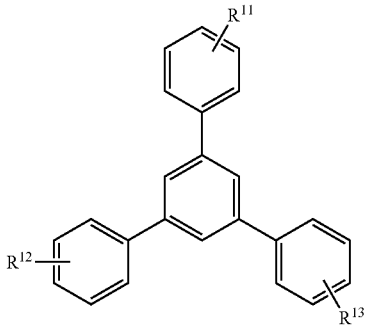

(In the general formula (2), $R^{11}$ to $R^{12}$ are respectively independent substituted groups and represent a hydrogen atom, a halogen atom, a substituted or unsubstituted alkyl group having 1 to 12 carbons, a substituted or unsubstituted alkoxy group having 1 to 12 carbons, a substituted or unsubstituted aryl group having 6 to 30 carbons, a substituted or unsubstituted aralkyl group having 6 to 30 carbons, a substituted or unsubstituted cycloalkyl group, a hydroxyl group, a cyano group, a nitro group, an amino group or a halogen alkyl group having 3 to 12 carbons);

(3)

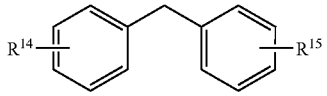

(In the general formula (3), $R^{14}$ and $R^{15}$ are respectively independent substituted groups and represent a hydrogen atom, a halogen atom, a substituted or unsubstituted alkyl group having 1 to 12 carbons, a substituted or unsubstituted alkoxy group having 1 to 12 carbons, a substituted or unsubstituted aryl group having 6 to 30 carbons, a substituted or unsubstituted aralkyl group having 6 to 30 carbons, a substituted or unsubstituted cycloalkyl group, a hydroxyl group, a cyano group, a nitro group, an amino group or a halogen alkyl group having 3 to 12 carbons);

(4)

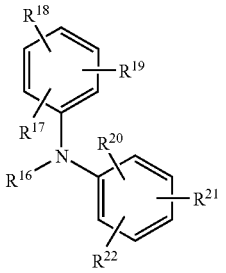

(In the general formula (4), $R^{16}$ to $R^{22}$ are respectively independent substituted groups and represent a hydrogen atom, a halogen atom, a substituted or unsubstituted alkyl group having 1 to 12 carbons, a substituted or unsubstituted alkoxy group having 1 to 12 carbons, a substituted or unsubstituted aryl group having 6 to 30 carbons, a substituted or unsubstituted aralkyl group having 6 to 30 carbons, a substituted or unsubstituted cycloalkyl group, a hydroxyl group, a cyano group, a nitro group, an amino group or a halogen alkyl group having 3 to 12 carbons).

7. The single layer type electrophotographic photoconductor according to claim 6, wherein a content of the additive with respect to a total weight of the photoconductive layer is set to a value which falls within a range of 1.5 to 15 weight %.

8. The single layer type electrophotographic photoconductor according to claim 1, wherein the said photoconductor provides a drum which diameter is set to 30 mm or less.

* * * * *